US009139321B2

(12) United States Patent
Baartmans

(10) Patent No.: US 9,139,321 B2
(45) Date of Patent: Sep. 22, 2015

(54) METHOD AND DEVICE FOR PACKAGING A PRODUCT

(75) Inventor: Hans Rudolf Baartmans, Sprundel (NL)

(73) Assignee: EASY2OPEN B.V. (NL)

( * ) Notice: Subject to any disclaimer, the term of this patent is extended or adjusted under 35 U.S.C. 154(b) by 693 days.

(21) Appl. No.: 13/504,634

(22) PCT Filed: Jan. 14, 2011

(86) PCT No.: PCT/NL2011/050024

§ 371 (c)(1),
(2), (4) Date: Jun. 5, 2012

(87) PCT Pub. No.: WO2011/090373

PCT Pub. Date: Jul. 28, 2011

(65) Prior Publication Data

US 2012/0266563 A1 Oct. 25, 2012

(30) Foreign Application Priority Data

Jan. 19, 2010 (NL) ..... 2004115
Oct. 26, 2010 (NL) ..... 2005579

(51) Int. Cl.
*B65B 61/18* (2006.01)
*B31B 1/90* (2006.01)
(Continued)

(52) U.S. Cl.
CPC . *B65B 61/02* (2013.01); *B31B 1/25* (2013.01); *B31B 1/90* (2013.01); *B31B 19/90* (2013.01);
(Continued)

(58) Field of Classification Search
CPC ..... B65D 75/5838; B65D 75/5894; B65D 2575/586; B31B 2219/90; B31B 2219/9012; B31B 19/90; B31B 1/90; B65B 61/184; B65B 61/18
USPC ..... 53/412, 427, 441, 133.3, 133.4, 133.8, 53/509, 556; 156/268; 493/212, 213
See application file for complete search history.

(56) References Cited

U.S. PATENT DOCUMENTS 1,983,323 A * 12/1934 Stokes ..... 493/55
4,228,633 A * 10/1980 Corbic ..... 53/412
(Continued)

FOREIGN PATENT DOCUMENTS

DE 1511033 9/1969
DE 2247516 5/1973
(Continued)

OTHER PUBLICATIONS

International Searching Authority, International Search Report for PCT/NL2011/0050024, 9 pages, mailed Jun. 24, 2011.
(Continued)

*Primary Examiner* — Stephen F Gerrity
(74) *Attorney, Agent, or Firm* — Tucker Ellis LLP

(57) ABSTRACT

The invention relates to a method and a device (1) for packaging a product in a packaging material. It also relates to packaged products obtained by packaging them in the packaging material that has been provided with one or more openings, in order to make it easy to open the package. The packaged products can also be provided with a cover element. A punching unit (5) is also described that comprises a rotatable backing roll (34), a rotatable punch roll (33) and a frame in which the backing roll (34) and the punch roll (33) are arranged with respect to each other, and where the punch roll (33) can rotate independently of the backing roll (34). The punch roll (33) can make one or more openings in the packaging material.

45 Claims, 14 Drawing Sheets

Figure 1:
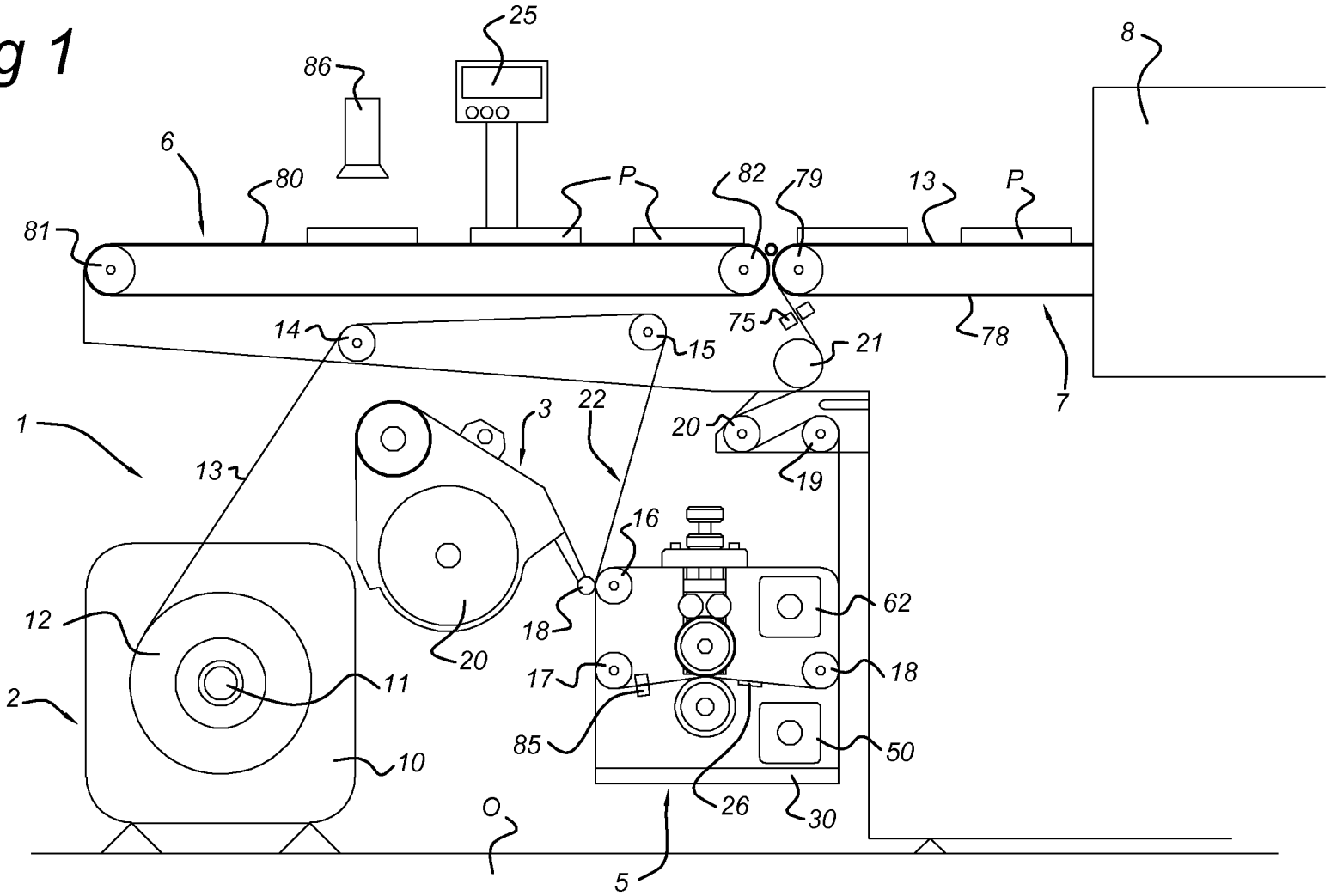

(51) Int. Cl.

| | |
|---|---|
| ***B65B 61/02*** | (2006.01) |
| ***B31B 19/90*** | (2006.01) |
| ***B65D 75/58*** | (2006.01) |
| ***B31B 1/25*** | (2006.01) |
| ***B65D 85/76*** | (2006.01) |
| ***B31F 1/10*** | (2006.01) |

(52) U.S. Cl.

CPC ..... *B31F 1/10* (2013.01); *B65B 61/184* (2013.01); *B65D 75/5838* (2013.01); *B65D 75/5894* (2013.01); *B65D 85/76* (2013.01); *B31B 2201/255* (2013.01); *B31B 2201/257* (2013.01); *B31B 2201/9023* (2013.01); *B31B 2219/90* (2013.01); *B31B 2219/9012* (2013.01); *B65D 2575/586* (2013.01)

(56) References Cited

U.S. PATENT DOCUMENTS

| | | | | | |
|---|---|---|---|---|---|
| 4,653,250 | A | * | 3/1987 | Nakamura | 53/412 |
| 5,161,350 | A | | 11/1992 | Nakamura | |
| 5,299,410 | A | | 4/1994 | Freeman | |
| 5,524,420 | A | | 6/1996 | Ikuta | |
| 5,938,013 | A | | 8/1999 | Palumbo et al. | |
| 7,681,732 | B2 | * | 3/2010 | Moehlenbrock et al. | 206/459.1 |
| 2003/0191001 | A1 | | 10/2003 | Guiot et al. | |
| 2004/0083680 | A1 | * | 5/2004 | Compton et al. | 53/133.6 |
| 2004/0092374 | A1 | | 5/2004 | Cheng | |
| 2005/0276525 | A1 | | 12/2005 | Hebert et al. | |
| 2008/0156861 | A1 | * | 7/2008 | Sierra-Gomez et al. | 229/214 |
| 2009/0304874 | A1 | * | 12/2009 | Stephens et al. | 426/122 |
| 2010/0113239 | A1 | * | 5/2010 | Peterson | 493/187 |
| 2012/0128835 | A1 | * | 5/2012 | Lyzenga et al. | 426/122 |
| 2013/0114918 | A1 | * | 5/2013 | Lyzenga et al. | 383/203 |

FOREIGN PATENT DOCUMENTS

| | | | | | |
|---|---|---|---|---|---|
| EP | 60411 | A1 | * | 9/1982 | B65D 75/5838 |
| EP | 0403089 | | | 12/1990 | |
| EP | 0953372 | | | 11/1999 | |
| EP | 1123874 | A1 | * | 8/2001 | B65B 61/184 |
| EP | 0954474 | | | 4/2002 | |
| FR | 1488045 | A | * | 7/1967 | B65D 75/5838 |
| WO | 2004087527 | | | 10/2004 | |
| WO | 2010013218 | | | 2/2010 | |

OTHER PUBLICATIONS

European Patent Office, Extended European Search Report for EP14166800.4, Jun. 23, 2014, 7 pages.

* cited by examiner

METHOD AND DEVICE FOR PACKAGING A PRODUCT

The present invention relates to a device and a method for packaging a product. One aspect of it relates to a punching unit, a device and a method for punching one or more openings in a material, such as a packaging material used to package a product. Another aspect of the invention relates to a device and a method for the subsequent packaging of the product in a packaging material that has been fitted with the one or more punched openings. The invention also relates to the packaged product thus obtained.

Products can be packaged in shrink film. Such a packaging film consists of a plastic material that tends to shrink when heated. This property is utilized for shrinking the packaging film around a product, such that it tightly fits around the latter and can protect it well from its surroundings. In the case of natural products such as certain kinds of cheese, especially certain kinds of soft (i.e. cream) cheese, for example brie, it is known to open the packaging that has been tightly applied over the product by cutting it. The user can make such a cut either with a knife or with scissors. The user's aim here is to put his or her finger partly through the opening cut in the packaging film when opening the package, and then pull the film in order to tear it open. However, since the film is shrunk tightly on the product and/or since the shrink film used is fairly tough after the shrinking process, it is difficult to remove the packaging material quickly and without damaging the product. When the product consists for example of a relatively soft and yielding material, it is sometimes impossible to avoid deforming or even damaging it.

Furthermore, soft cheese and similar products are cut lengthwise, so the film must be torn open crosswise. However, it has been found difficult to tear the package open in the transverse direction, so the product is often damaged as a result.

Another problem that occurs specifically with the use of shrink film is that, although the latter is tough after heating, it is fairly soft (limp) and flexible before heating. Furthermore, shrink film is often quite stretchable in all directions, and it can be torn more easily after it is shrunk. This makes it difficult to work such a package, e.g. by punching a cut in it before the film is subjected to a shrinking process. These problems apply to stretch film (or combined stretch-shrink film), and can also occur for example in the case of skin-packaging film.

It is possible to use a perforating roll to introduce perforations to the film locally in order to form a perforated line in the longitudinal direction of the film. A label is then stuck on the perforated line to seal the film. The film can then be shrunk over the product. To open the package, the user pulls off the label in a direction normal to the product to open it along the perforations and pull the film to the lateral edge of the product. However, it has been found that such a perforated line does not always tear open as easily as it is supposed to. Depending on the shape and/or properties of the product itself, the product cannot be easily taken out of the package when the latter is opened in this way in the transverse direction.

Food products such as pieces of cheese generally vary in size and shape. It may therefore be desirable to vary the punching of the opening according to the size, shape or other characteristics of the product, and/or to vary the distance between subsequently punched openings.

It is generally difficult to work a relatively soft (limp) and flexible packaging material (other than a shrink or stretch film) and to provide it with an opening to allow that the packaging material can later be removed from the product in a simple way.

It may be desirable to provide a packaged product whose packaging material can be easily removed, so the product can be taken out of the package in a simple manner.

It may be desirable to provide a method and device for packaging products, and/or to provide a packaged product in which one or more of the above problems and/or other problems affecting the current state of technology is/are remedied.

It may be desirable to provide a punching unit, as well as a method and device with the aid of which one or more openings can be made in a relatively soft and flexible packaging material.

It may be desirable to provide a punching unit wherein one or more of the above problems and/or other problems affecting the current state of the art are obviated, and which is particularly suitable for punching one or more openings in packaging material, such as a film for packaging cheese, or other types of film, in a flexible manner.

According to one aspect of the invention, a punching unit is provided comprising a rotatable backing roll, a rotatable punch roll and a frame in which the backing roll and the punch roll are mounted with respect to each other in such a way that the punch roll can rotate independently of the backing roll. Since the backing roll and the punch roll can rotate independently of each other, it is possible to rotate the two at different speeds. With such a punching unit, the backing roll can for example rotate at the same speed as the packaging material on it, while the speed of the punch roll can vary for example between this speed, during the punching operation starting from an initial position, and a second, different speed, at which the punch roll—after completing the punching operation—can rotate on to a waiting position for the next punching operation. The punch roll can also be kept stationary in its waiting position. In this way, for example, the distance between two successive punching operations can be varied at will. When the punch roll can only be rotated in accordance with the backing roll as usual, and when both the punch roll and the backing roll rotate at the same speed as the packaging material moving between them, the distance between two successive punching operations is equal to the circumference of the punch roll, if this is fitted with a single punch, or it is equal to of the distance along the circumference between two successive punching operations on the circumference of the punch roll if the latter is fitted with two or more punches. In the case of the conventional punching units, therefore, the distance between two successive punching operations is fixed by the characteristics of the punch roll. The present invention provides a more flexible punching unit, with which for example the distance between two successive punching operations can be varied without interrupting the work. The distance between two punching operations can also be varied between a first run, using for example a first fixed distance, and a second run, using for example a second fixed distance, without having to replace the punch roll by for example a punch roll that has a different number of punches and/or a different circumference.

In some of the embodiments of the present invention, the punch roll is fitted with at least one punch, which is mounted on the punch roll and is used for making an opening in the packaging material, starting from an initial position where the packaging material is fed in at its feed velocity.

In some other embodiments of the present invention, the packaging material fed in is fitted with one or more cover elements. The punching unit can be used to punch an opening through the packaging material right up to the cover element.

The resulting opening is suitable for example for tearing the packaging material in a first direction and then in a second direction which is for example basically opposite to the substantially transverse first direction, in order to be able to remove the packaging material at least partly from the product.

Other embodiments are described in the dependent claims.

Another aspect of the present invention relates to a device for packaging a product, comprising:

a feed unit for feeding the packaging material, for example a shrink film, a stretch film or a combined stretch-shrink film, a punching unit according to an embodiment of the first aspect, and a packaging unit for packaging the product with the packaging material.

In one of the embodiments, the device also comprises a cover-element applying unit, which places at least one cover element on the packaging material.

According to another aspect of the present invention, a packaged product is provided that is obtained by using a device according to one of the embodiments.

The product can be for example a piece of cheese, especially a piece of soft (i.e. cream) cheese.

The packaging material is for example a shrink film, a stretch film, a combined stretch-shrink film, or a skin-packaging film ("skin film"). Other embodiments are specified in the dependent claims.

According to yet another aspect of the present invention, a packaged product is provided, which is packaged in a packaging material, such as for example a shrink film or a stretch film, to which at least one cover element has been applied and in which at least one opening has been made at the place of the cover element, substantially without making a corresponding opening in the cover element, so that the opening or openings is/are only formed in the packaging material, in order to tear the packaging material in a first direction and then in a second direction to remove it at least partly from the product. The shape of the opening or openings makes it possible to tear the package off the product in a simple way, so that the product can be easily taken out of its package.

According to another aspect of the present invention, a method is provided for packaging a product, comprising feeding in a packaging material, such as for example a shrink film or a stretch film, applying at least one cover element to the packaging material, forming at least one opening in the packaging material at the place of the cover element, substantially without forming a corresponding opening in the cover element that lies beyond it, so that the opening or openings is/are formed only in the packaging material, in order to make it possible to tear the packaging material in a first direction and then in a second direction to remove it at least partly from the product, and packaging at least one product in this packaging material.

This method gives a packaged product whose packaging is easy to tear off the product, so the latter can be easily taken out of its package.

According to another aspect of the present invention, a method is provided for the in-line packaging of a product, comprising:

feeding in a packaging material, which can be a shrink film, a stretch film, a combined stretch-shrink film or a packaging material that is used on a skin-packaging machine, applying at least one cover element to the packaging material, forming at least one opening in the packaging material at the place of the cover element, substantially without forming a corresponding opening in the cover element that lies beyond it, and packaging at least one product in the packaging material, comprising arranging at least one product in the packaging material and sealing the packaging material.

The use of this method makes it possible to obtain a packaged product in the case of which at least one opening is cut in a shrink film, a stretch film, a combined stretch-shrink film or a packaging material that is used on a skin-packaging machine (i.e. a skin film). As mentioned above, it is difficult to work this kind of film. However, the problems can be avoided or at least greatly reduced by the in-line application of a cover element, the formation of at least one opening, and the packaging.

According to another aspect of the present invention, a method is provided for packaging a product, comprising:

feeding in a packaging material, applying at least one cover element to the packaging material, forming at least one opening in the packaging material at the place of the cover element, substantially without forming a corresponding opening in the cover element that lies beyond it, the opening being formed by a punching unit according to an embodiment of the first aspect of the invention, and packaging at least one product in the packaging material.

The packaging operation can be integrated with the other method steps to make a fully in-line packaging process possible. In some other embodiments, the packaging is carried out off-line, that is, the application of cover elements (such as labels, for example) and the formation of openings are carried out separately from the packaging of the products. In the case of an off-line packaging process, the packaging material with the cover elements applied to it is intermediately stored on a roll.

The cover element can be a label, which may be a self-adhesive label or sticker, or a different kind of label, but embodiments in which the cover element is a longitudinal strip are also possible. Furthermore, the cover element can be applied either to a treated or to an untreated film. The opening is then formed at the place of the cover element, using for example a punching unit or a laser cutting unit. The presence of the cover element can make the film less limp locally, so it becomes easier to position the film and to form an opening in it at the right place with the aid of the unit used. The opening made in the package can therefore have a suitable shape that enables the user to tear the package open easily and remove the product from it. Thus, the opening can be an elongated and substantially non-interrupted (continuous) opening. In some other embodiments, a series of smaller openings or perforations is made, which jointly form a perforated line, along which the package can be easily torn open.

Furthermore, the packaging material used to package the product can fully cover the latter, but other packaging types are also possible and they all lie within the scope of packaging as defined here. For example, it is possible to use the packaging material for sealing another packaging material, e.g. for sealing for example a plastic container, a tray or a bottom-track support, e.g. in the case of a deep drawing or top-seal machine.

In a preferred embodiment, the method furthermore comprises:

feeding in a packaging material from a feed roll, applying at least one cover element to the packaging material, thereafter passing the packaging material to which at least one cover element has been applied along a punching unit, and forming an opening in the packaging material at the place of the cover element, which opening is arranged for opening the package by hand.

The cover element is stuck on the packaging material with the aid of an adhesive, such as glue, for example, and it is then used as a reference point for punching an opening in the packaging material. The opening is preferably punched through the packaging material, right up to the cover element, while the latter remains substantially intact. As a result, not only does the cover element retain its nice appearance, but also the product can be sealed in the package in an airtight manner, despite the presence of an opening (naturally as long as the cover element remains stuck to the packaging film).

Besides using a punching unit for making an opening, other methods are also possible, such as for example passing the packaging material to which at least one cover element has been applied along a laser cutting unit to form an opening in the packaging material at the place of the cover element. A laser cutting unit has the advantage that it is generally lightweight and, in addition, it does not need a heavy drive unit, which is needed for example for punching the cover element.

When the cover element has been applied and the opening has been formed, one or more products can be inserted in the packaging material, and the latter is then arranged around the product or products. After that, the packaging material is sealed, so the assembly of the product and the packaging material is ready for further treatment.

When the packaging material is a shrink film, it can be further treated by heating the combination of the product and the film in order to shrink the film over the product.

Any kind of shrink film can be used as the packaging material, for example a barrier film (which is a shrink film designed to form a barrier for air and gases) or a film having no special barrier properties, a single-layer film, a multi-ply film, a laminated film, a co-extruded film, a coated film and/or a metalized film. The material for the cover element can be chosen according to the type of packaging material used. For example, if a barrier film is used as the packaging material, it is best to provide the cover element with a barrier. This can improve the leak-proof nature of the package.

As mentioned before, the shrink film is relatively soft and flexible, which makes it difficult to work. Substances that can be used for making the packaging material include an ethylene-vinyl alcohol (EVOH) copolymer, an ethylene-vinyl acetate (EVA) copolymer, polypropylene, polyethylene, polyvinyl chloride, nylon, polyamide, polyester and various copolymers. These materials can be soft and flexible, for example when the packaging material has a thickness of between 5 and 35 μm.

In another embodiment of the present invention, the method comprises the following steps:

conveying a band of packaging material to a cover-element applying unit, applying a series of cover elements to the band of packaging material using the cover-element applying unit, passing the band of packaging material, fitted with its cover elements, along an opening-forming unit, and forming an opening by means of the opening-forming unit only in the packaging material every time a cover element passes, substantially without making a corresponding opening in the cover element that lies beyond it.

The distance between the succession of cover elements can be chosen at will in the various embodiments of the invention, so that the required cut-off length is ensured every time. This cut-off length depends for example on the shape and/or size of the product to be packed and/or on the gap between the products that is needed for the correct operation of the packaging machine.

In one of the embodiments of the present invention, the opening-forming unit comprises a laser cutting unit, which uses a laser beam to form an opening every time a cover element passes, but only in the packaging material, substantially without forming a corresponding opening in the cover element that lies beyond it.

In one of the embodiments of the present invention, the opening-forming unit comprises a punching unit, which is used for cutting these openings.

In another embodiment, the method according to the invention comprises the following steps:

conveying a band of packaging material to a cover-element applying unit, applying a series of cover elements to the band of packaging material by the cover-element applying unit, passing the band of packaging material provided with cover elements along a punching unit, and punching an opening by means of the punching unit but only in the packaging material, right up to the cover element, every time one of the cover elements passes.

In this way a large number of cover elements can be fitted with one or more openings in a quick and efficient manner. Furthermore, the distance between the successive cover elements (e.g. labels) can be chosen at will, so that the required cut-off length can be ensured. The cut-off length depends for example on the shape and/or size of the product that is being packed, on the gap between the products that is needed for the correct operation of the packaging machine, on the tool dimensions of the packaging machine, on any identification points on the packaging material, etc. or else the cut-off length can have for example a value set in advance.

The cut-off length can be set manually, for example before packaging a number of products with known dimensions, but it can also be set on the basis of an electronic signal generated by an external scanner. The external scanner can for example scan the products when they are being fed in, and the best cut-off length can then be calculated and transmitted for each product separately, depending on the scanned image.

In another embodiment, the method comprises the following steps:

forming at least one first opening in the packaging material at the place of the cover element, substantially without forming a corresponding opening in the cover element that lies beyond it, this first opening being arranged for opening the package by hand, and forming at least one second opening, at the place of the cover element, in the combination of the packaging material and the cover element that lies beyond it.

This second opening can be used as a ventilation opening, but it can also serve another purpose.

The first opening is intended to make it possible to open the package after removing the cover element. The second opening, which is made both in the packaging material and in the cover element, can be used for ventilation, whether it can be closed or not. In some situations it is advisable to allow air or gases to escape from the packaged product for a time before finally closing the package hermetically, which can be done by applying a second cover element over the second opening. This second cover element can be applied before and/or after the packaging material is passed into a further packaging unit, especially a sealing unit, and also before and/or after it is passed into a shrinking unit for shrinking the packaging material.

The opening or openings that is/are made in the packaging material can have many different shapes. In the case of elongated products, it is often preferable to make the opening lie substantially normal to the longitudinal direction of the product. This is because the package can then be gripped at the opening and opened in the longitudinal direction. If the package is pulled open in the longitudinal direction, it can be torn open over a relatively great length before reaching a seal line. Seal lines can be even tougher than the rest of the packaging material, so it is particularly difficult to tear the package open at them. It is possible to provide the opening with tear-tabs at a couple of places in order to make it easier to tear the package open and/or to help the user to tear into the package at the right points.

In all the packs known so far, the openings are made in such a way that the package can only be torn open in one direction. In a particularly advantageous embodiment of the present invention, however, the opening that is made only in the packaging material is used not only to tear the package open in a first direction, but also to make it possible to then tear the package open in a second—substantially opposite—direction, so as to be able to remove the packaging material from the product more easily, or even more easily than otherwise. For example, the opening can be provided with two different sets of tear-tabs. The first set of tear-tabs is formed for tearing into the package in a first direction, while the second set is formed for tearing into the package in a second direction. The first set of tear-tabs can be formed for example by a number of tear lines running normal to the opening, in a first longitudinal direction, while the second set is then formed by a number of tear lines running normal to the opening in the opposite longitudinal direction.

In one of the embodiments according to the invention, the steps involved in the method are carried out a number of times in succession. The method may, for example, comprise the following steps:

- carrying out the method steps to package the product in a first packaging material, and
- repeating the method steps to package the same product in a second packaging material.

The same kind of packaging material can be used here in both steps, but embodiments are also possible in which the second packaging material is different from the one used in the first step.

One of the packaging materials can be enclosed in the other one and/or it can be joined to the other one, for example by (tightly) enveloping it by means of shrinking, glueing, sealing and/or welding.

The method according to the present invention can include the formation of one or more openings in the packaging material. When two or more openings are formed, this can be done in the form of a row of perforations, lying one after the other. A perforated line can be formed in the packaging material in this way. The size of the perforations and the distance between the openings can then be chosen so that the perforated line opens up when the cover element is pulled off.

According to another aspect of the invention, a packaged product is provided that is obtained by one of the methods described here for the various embodiments of the invention. In these embodiments the packaged product is a piece of cheese, such as for example a piece of soft cheese.

As mentioned before, the opening made in the packaging material in certain embodiments is substantially normal to the longitudinal direction of the band of film. In some other embodiments, however, it is better if the opening extends substantially in the longitudinal direction. In another embodiment, the cover element has an adhesive-free area, so that a pull-tab that protrudes from the package is formed, with the aid of which the cover element can be removed from the packaging material. The user can grip the first pull-tab on the still packaged product, and—when he or she then gradually pulls the cover element by its pull-tab at least partly off the packaging material—part of the packaging material also pulls off, so the package can be torn open from e.g. the ends of the opening or the pull-tabs at the opening.

According to another aspect of the invention, a device is provided for packaging a product, which device comprises:

- a feed unit for feeding in the packaging material,
- a cover-element applying unit for placing at least one cover element on the packaging material,
- an opening-making unit that cuts at least one opening in the packaging material, wherein the opening-making unit is configured to form an opening in the packaging material right up to the cover element, substantially without making a corresponding opening in the cover element that lies beyond it, and
- a packaging unit for packaging the product with the packaging material.

In another embodiment, a device is provided for packaging a product, which device comprises:

- a feed unit for feeding in the packaging material, such as for example a shrink film or a stretch film,
- a cover-element applying unit for placing at least one cover element on the packaging material,
- an opening-forming unit to form at least one opening in the packaging material at the place of the cover element, wherein this unit is configured to form an opening through the packaging material, right up to the cover element, substantially without forming a corresponding opening in the cover element that lies behind it, so that the opening or openings is/are formed only in the packaging material, in order to tear the packaging material in a first direction and then in a second direction to remove the packaging material at least partly from the product, and
- a packaging unit to package the product with the packaging material.

The use of this device gives a packaged product that can be easily torn free of the packaging material and so it can be easily removed from the packaging by a simple move.

The packaging unit can be integrated with the other units of the device, so that a fully in-line packaging process can be achieved. In some other embodiments, the application of the cover elements (e.g. labels) and the formation of the openings are carried out separately from the packaging of the product, in an off-line packaging process. The in-line packaging process, in which the packaging material that has been fitted with cover elements need not be wound up again, can make it possible for example to use a relatively thin packaging material with relatively thick cover elements. When, in an off-line packaging process, such a thin packaging material, fitted with relatively thick cover elements, has to be wound up again, this can involve the risk of obtaining an irregular roll because of the relatively large difference in thickness between packaging material sections without any cover elements, and packaging material sections to which cover elements have been applied, the total thickness of the packaging material with cover elements being very different from the thickness of the packaging material alone.

In a preferred embodiment of the invention, the packaging material is a shrink film, and the packaging machine has a sealing unit, especially a flow-pack sealing unit, to seal the product in the film, and/or a heating unit, especially a shrink tunnel, to shrink the packaging material tightly over the product. Besides a flow-pack sealing unit, other sealing units can also be used, such as a conventional deep-drawing machine, a top-seal machine or a skin machine.

In one of the embodiments of the invention, the punch of the punching unit is used to make a first opening in the packaging material, substantially without making a corresponding opening in the cover element that lies beyond it, and also to make a second opening, this time both in the packaging material and in the cover element that lies beyond it.

The punching unit can have a first punch component with a relatively small height, and a second punch component with a relatively great height, so that when the punching unit carries out a punching operation with its first punch component, an opening is only created through the packaging material, while when the second punch component is used for punching, an opening is created substantially both through the packaging material and through the cover element.

Another embodiment comprises a cover-element applying unit whose function is to place another (i.e. a second) cover element on the packaging material after the formation of a ventilation opening in the cover element, the aim of this second cover element being to close the ventilation opening again hermetically. The second label or cover element at least partly overlaps the first one in order to cover the ventilation opening in the label. This second cover-element applying unit can be a separate unit.

In another embodiment of the invention, the punching unit comprises a rotatable backing roll, a drive motor for rotating this backing roll, a speed sensor for both determining the speed at which the packaging material is fed in and for emitting a velocity signal that represents the feed velocity, and a control unit that is coupled to the drive motor and to the speed sensor, and which is used to adjust the speed of rotation of the backing roll according to the velocity signal received. In another embodiment, the control unit is used to produce a control signal in order the ensure that the speed and/or acceleration of the backing roll are/is substantially the same as those of the packaging-material fed in, without a time lag between them. Owing to this arrangement and to an encoder that can count the set steps involved and so determine exactly when a cover element has to be released, the cover element can be applied to the packaging material in exactly the right position, even if the film is very supple and flexible.

In a certain embodiment, a light-weight backing roll is used, which can be achieved by making it at least partly or substantially hollow. A reasonable weight-saving can be typically achieved by making the backing roll at least 50% hollow and preferably at least 80% hollow, thereby reducing its weight to the same extent.

In some other embodiments, the punching unit comprises:

- a backing roll, possibly fitted with two runners (i.e. small rollers),
- a rotatable punch roll, possibly fitted with two runners, which are preferably mounted on bearings, and
- a frame in which the backing roll and the punch roll are arranged with respect to each other. The runners are incorporated to ensure that the distance between the backing roll and the punch roll is kept at the required constant value throughout the rotation.

In another embodiment, the two runners of the punch roll can rotate with respect to the punch roll itself, since they are mounted on bearings. The punch roll can therefore rotate independently of the backing roll while still maintaining the required distance, due to the presence of the runners.

In another embodiment, the punching unit comprises a rotatable backing roll and a punch roll that can rotate substantially independently of the backing roll, wherein the punch roll has a central part and a punching part which is mounted such that it can be displaced sideways with respect to the central part, as well as fixed in any lateral position in relation to the backing roll. This arrangement can also keep the weight of the punch roll low and make it easy to set the position of the punch for forming openings in the right places in the lateral direction.

In some embodiments of the invention, the punch roll, when punching, rotates at exactly the same speed as the backing roll, which in turn rotates at exactly the same speed as the band of film. The punch roll has an initial position. As soon as the cover element is detected just upstream of the punch roll, the latter starts rotating at exactly the same speed as the backing roll. The film is then punched through to form an opening downstream of the cover element. When the punching tool is just past the backing roll, it starts to return to its initial position, but at a higher speed, and then it stops there, waiting for a new signal to rotate again. The initial position can also be called the waiting position. In some embodiments of the invention, the punch roll has a single punching tool on its circumference, and the initial position of the punch roll preferably corresponds to a single predetermined rotational position of the punch roll, where the punching tool can stand in readiness to perform a punching operation. In some embodiments, the punch roll is fitted with two or more punching tools, situated in various positions along the circumference of the punch roll. These punching tools can be used in a fixed sequence, for example one after the other. The initial position of the punch roll preferably corresponds to a subsequent rotational position of a number of predetermined rotational positions of the punch roll, where the next punching tool of the set can always stand in readiness to perform the next punching operation. The punch roll can then rotate between two successive punching operations, for example to the next rotational position, so that the punch roll can for example be in readiness for the next punching operation in less time than in the case of a single punching tool, so it can reach for example a higher transit speed.

The faster rotation of the punch roll can be achieved in an embodiment by fitting the punch roll with two runners, mounted on bearings. As a result, the two runners of the punch roll can rotate with respect to the punch roll, so the punch roll can rotate independently of the backing roll. The latter can therefore rotate at the speed of the band of film, while the punch roll can move on to its initial position faster, for the next punching operation after the previous one has been completed. Owing to the presence of the runners, the required gap can be maintained, so that the punch roll is always pressed against the backing roll with a force that is suitable for punching. In another embodiment, the backing roll is fitted with two runners, which are mounted on bearings, so they can rotate with respect to the backing roll. This is an alternative way of making the punch roll rotate independently of the backing roll.

In some of the embodiments, the punch roll and the backing roll are driven by two separate drive motors, each having its own control unit. The control unit of the backing roll is used to regulate the drive motor of the backing roll in such a way that the speed and/or acceleration of the backing roll are/is substantially the same as those/that of the packaging material fed in, as described above. The control unit of the punch roll can be used for regulating the drive motor of the punch roll in such a way that—during the punching operation—its speed and/or acceleration agree(s) with those/that of the packaging material fed in, and—after this operation has been completed—the punch roll rotates on to its initial position at a higher speed, for the next punching operation. In another embodiment, these two control units are integrated to form a single control unit, which can regulate both drive motors.

In another embodiment, the punch roll comprises at least one magnetic part for the detachable fixing of a punch component to the surface of the punch roll. As a result, if another punch component has to be used (for example one that has a different shape or a different height), the punch roll does not have to be removed completely, for it is enough simply to exchange the punch component itself.

According to another embodiment of the invention, the device comprises:

a feed conveyor for feeding in a series of products, a scanner which is configured to detect at least one of the relative positions, kinds and dimensions of the products on the feed conveyor, and to emit a detector signal that represents the results of the detection, and control means that use the detector signal from the scanner to determine how much packaging material is needed for packaging each product.

According to another embodiment of the invention, the device comprises:

a feed conveyor for feeding in a series of products, a scanner which is configured to detect at least one of the relative positions, kinds and dimensions of the products on the feed conveyor, and to emit a detector signal that represents the results of the detection, and control means that use the detector signal from the scanner to determine the desired properties, in particular the position, shape and/or dimensions, of the openings to be made in the packaging material.

According to another embodiment, the device comprises:

a feed conveyor for feeding in a series of products, a scanner which is configured to detect at least one of the relative positions, kinds and dimensions of the products on the feed conveyor, and to emit a detector signal that represents the results of the detection, and control means that use the detector signal from the scanner to determine the desired positions where the cover elements are to be applied to the packaging material.

The feed conveyor is for example an endless conveyor belt, a series of articulated supports or containers such as trays, or a band of film in chain.

Any kind of scanner can be used, such as for example an optical scanner, and the unit can also consist of a set of scanners, for discerning the products for example at different angles or in different positions. The optical scanners used can consist for example of one or more cameras that is/are coupled to the control units (charge-couple devices in the form of CCD cameras). When for example the packaging machine is used for enclosing products of different shapes and sizes, the cut-off length of the packaging material can be identified for each product fed in, this being the length of packaging material that is needed to package the product in question correctly. Alternatively or additionally, the spot where a cover element is to be applied to the packaging material and/or an opening is to be formed in it can be identified. In addition to identifying the cut-off length, the control units and the scanner can be constructed in such a way that the required characteristics of the openings to be made in the packaging material can also be identified and possibly even set automatically, that is to say, without a manual operation. Possible characteristics of this kind include the position, shape and/or size of the openings (openings) in relation to the product to be packed. When the control units (e.g. microcontrollers) are coupled to at least one of the other units, namely the cover-element applying unit, the opening-making unit and the packaging unit, these units can be set separately or together in accordance with the detector signal emitted by the scanner.

According to another aspect of the invention, a punching unit is provided, comprising:

a backing roll, which may be fitted with two runners, a rotatable punch roll, which may be fitted with two runners that are preferably mounted on bearings, and a frame in which the backing roll and the punch roll are arranged with respect to each other.

In some embodiments, the two runners of the punch roll can rotate with respect to the punch roll, because they are mounted on bearings.

In some of the embodiments, the punching unit comprises both a rotary backing roll and a punch roll that can rotate substantially independently of the backing roll.

In some of the embodiments, the punch roll and the backing roll are driven by their own drive motors, which are regulated by separate control units. The control unit for the backing roll can be used to regulate the drive motor of the backing roll in such a way that the speed and/or acceleration of the backing roll are/is substantially the same as those of the packaging material fed in, as described above. The control unit of the punch roll can be used to regulate the drive motor of the punch roll in such a way that—during the punching operation—its speed and/or acceleration are/is the same as those/that of the packaging material fed in, while—after the punching operation has been completed—the punch roll preferably moves on to its initial position at a higher speed, for the next punching operation. In another embodiment, the different control units are integrated to form a single control unit that can regulate both drive motors.

Other embodiments of the punching unit are as described above.

Figure 2:
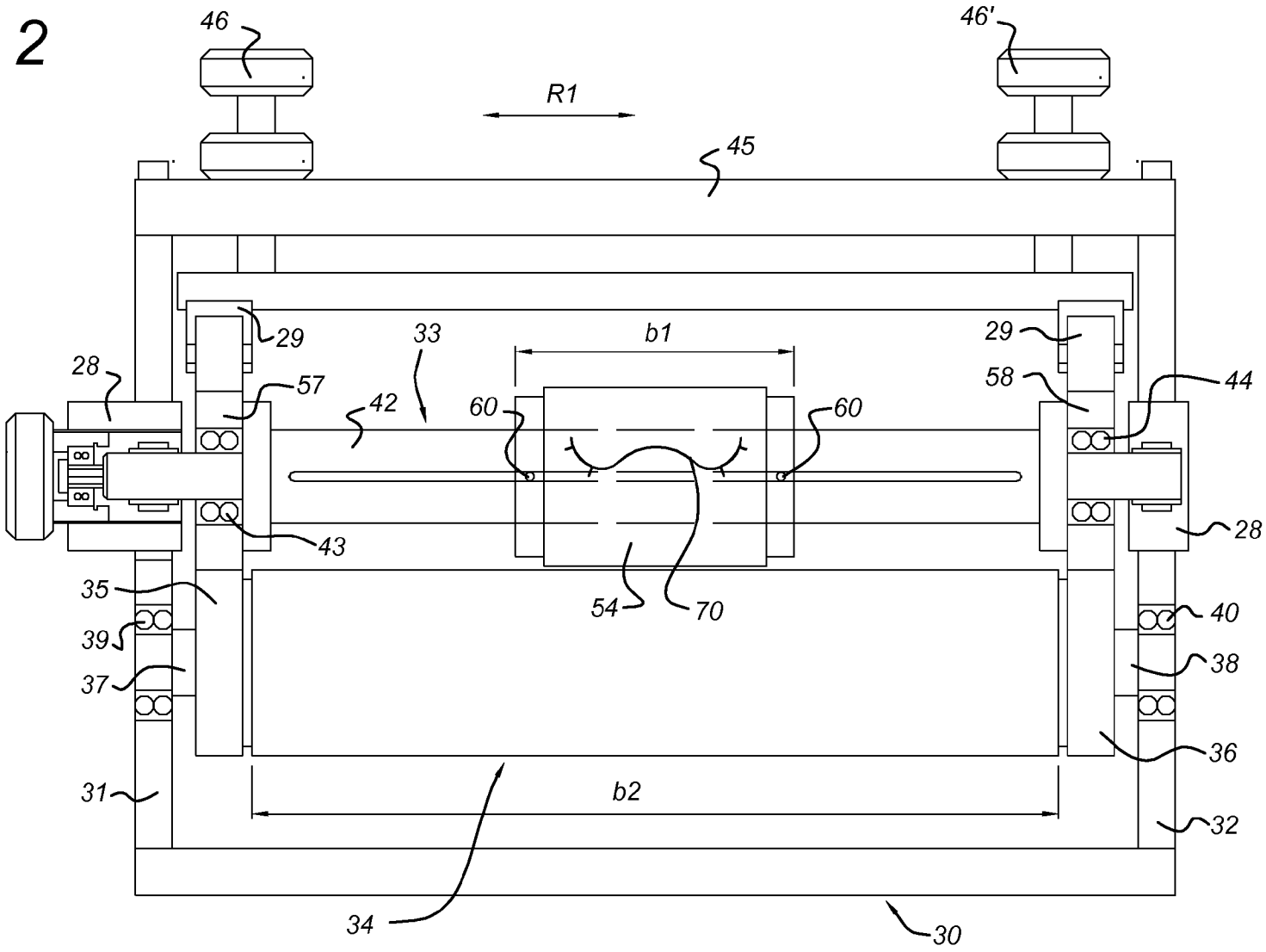
Figure 3:
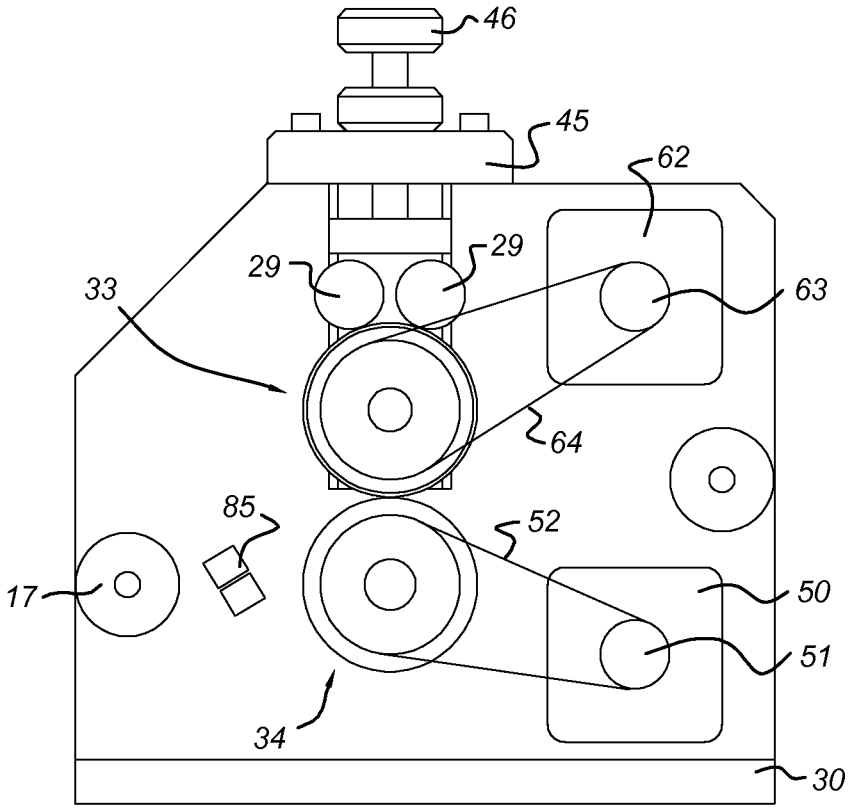
Figure 4A:
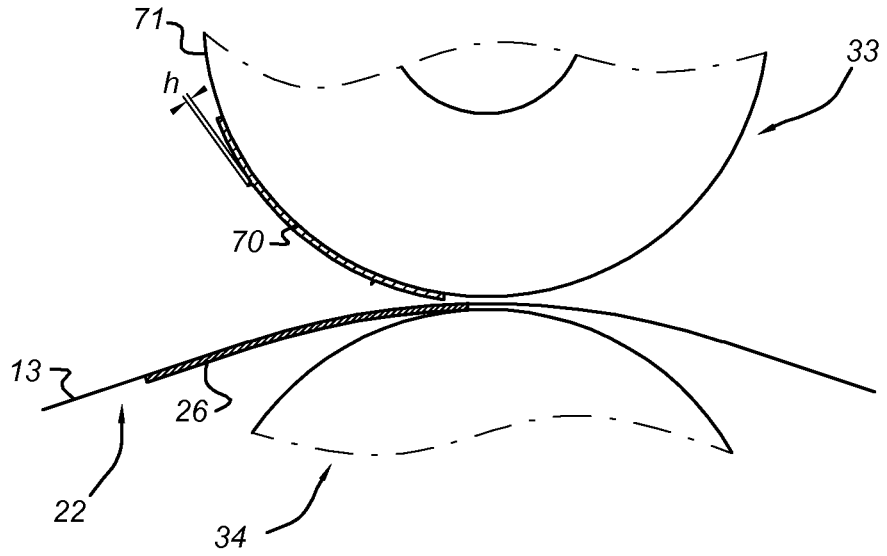
Figure 4B:
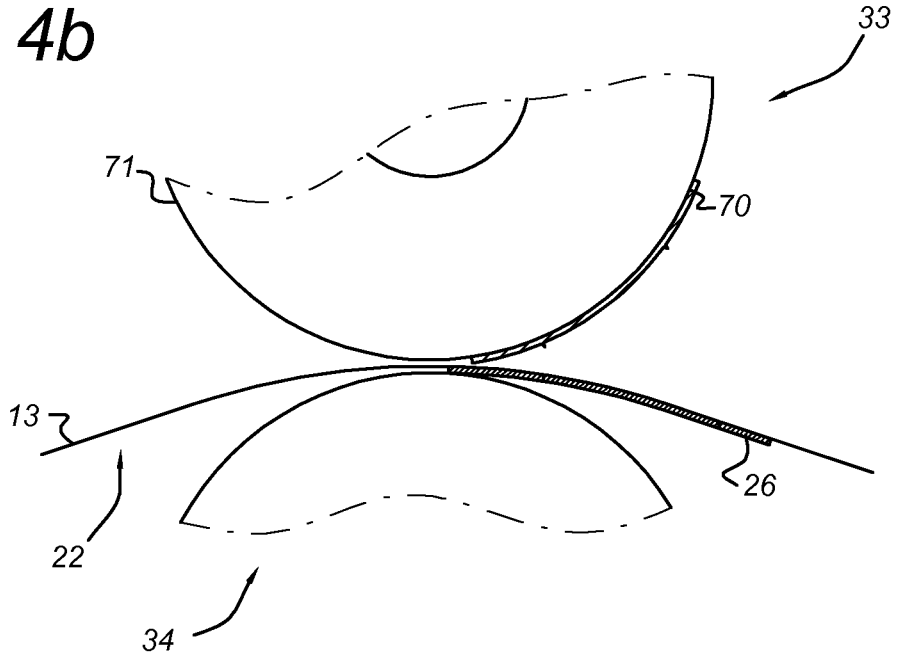
Figure 5A:
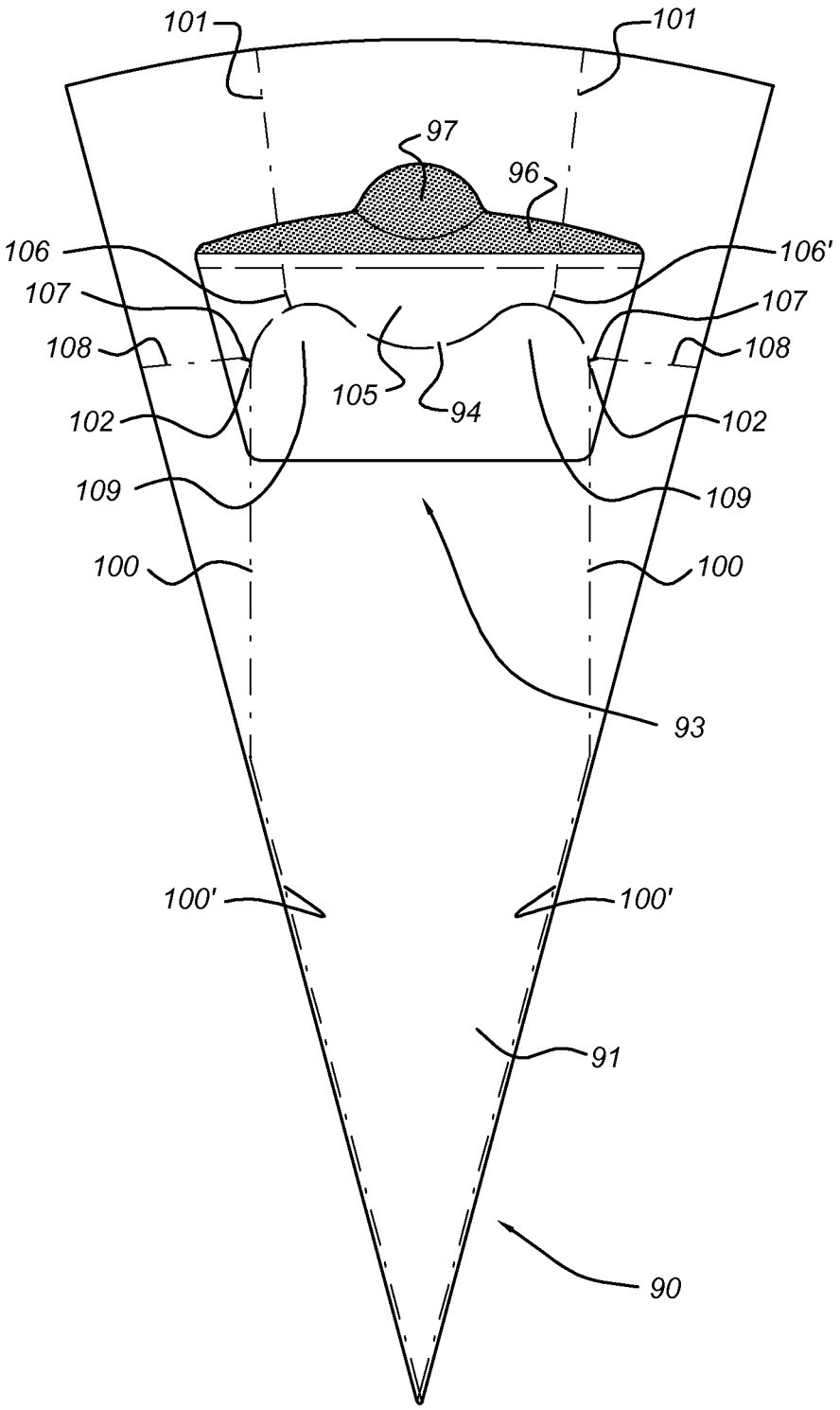
Figure 5B:
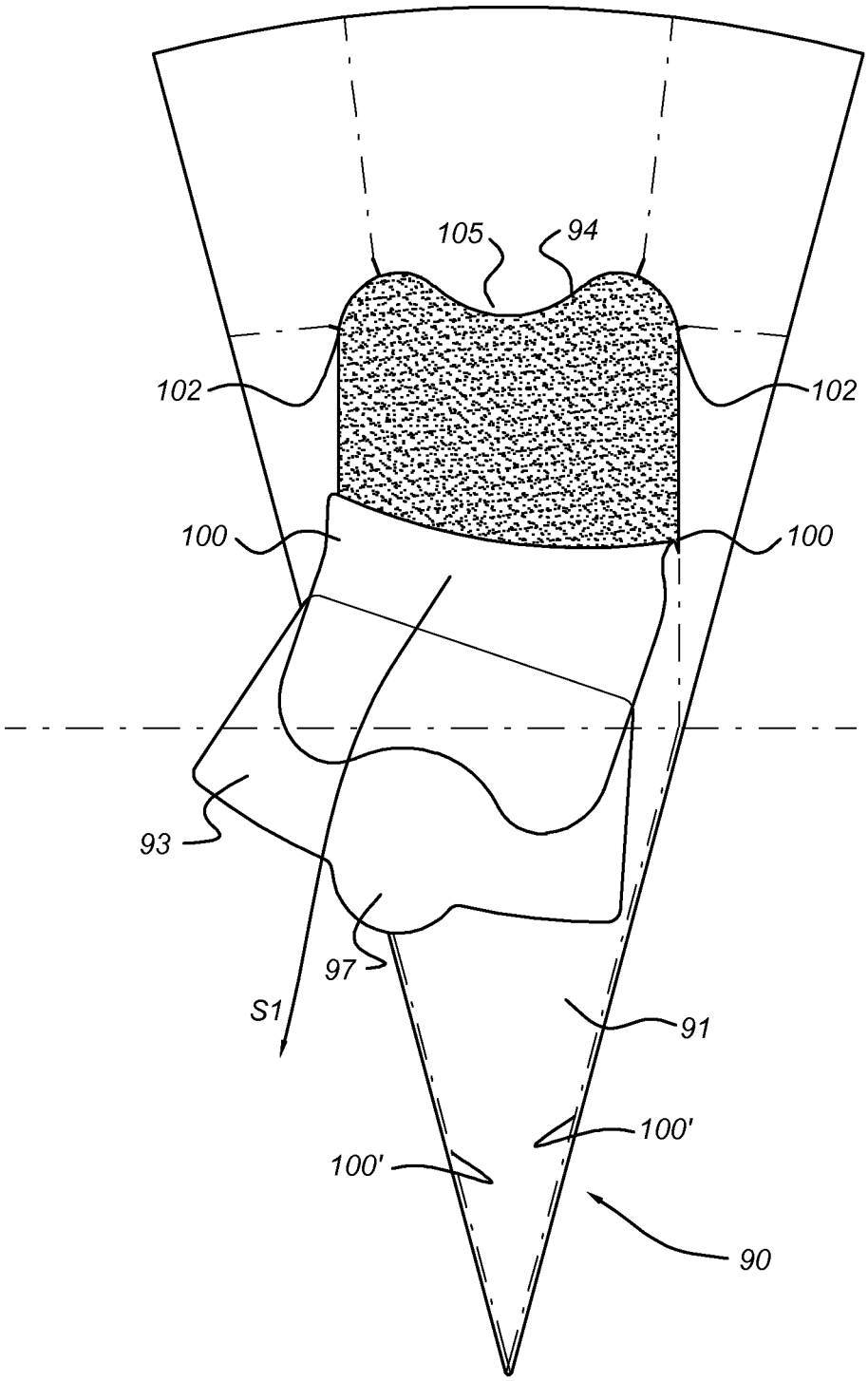
Figure 5C:
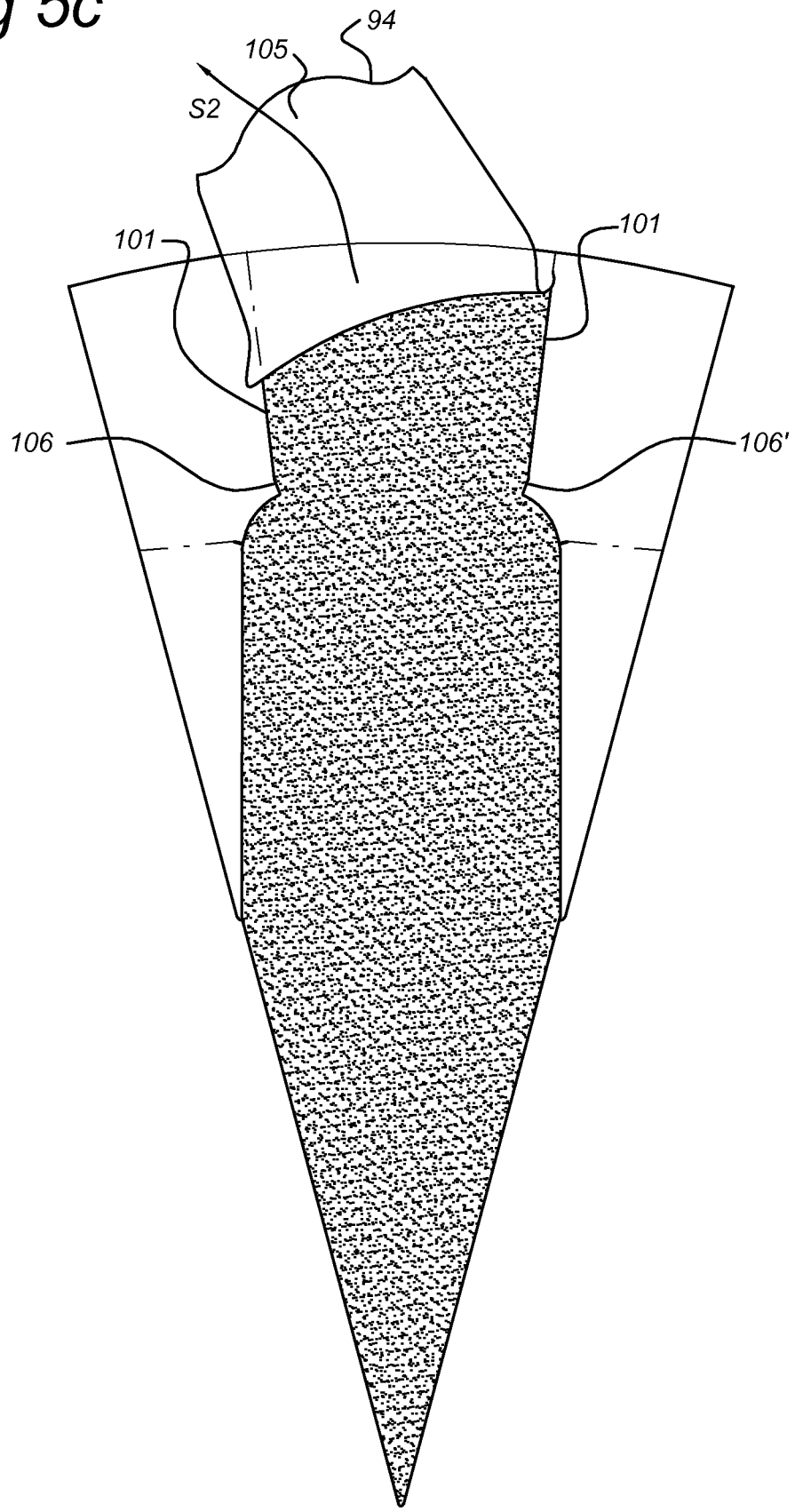
Figure 5D:
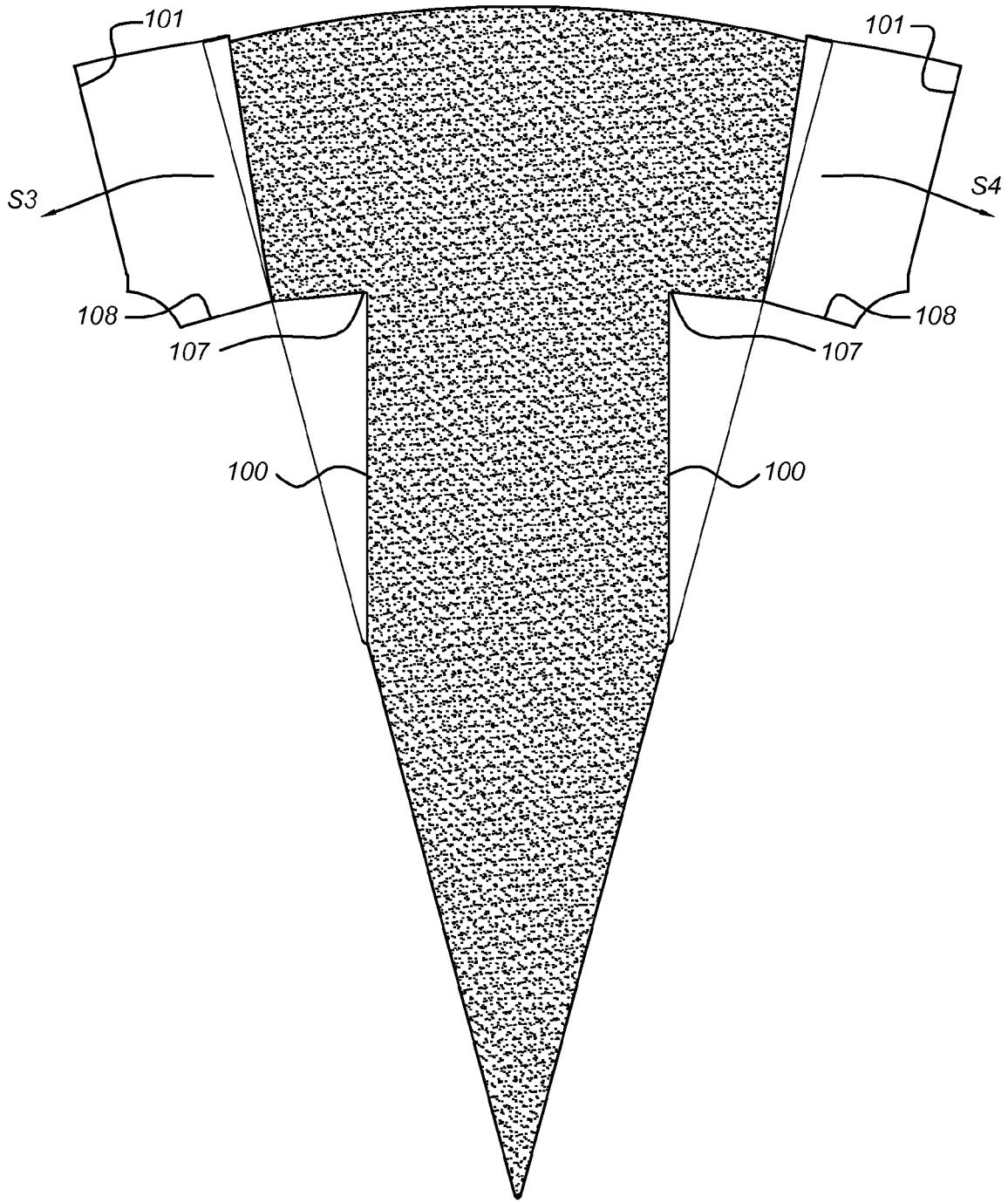
Figure 6:
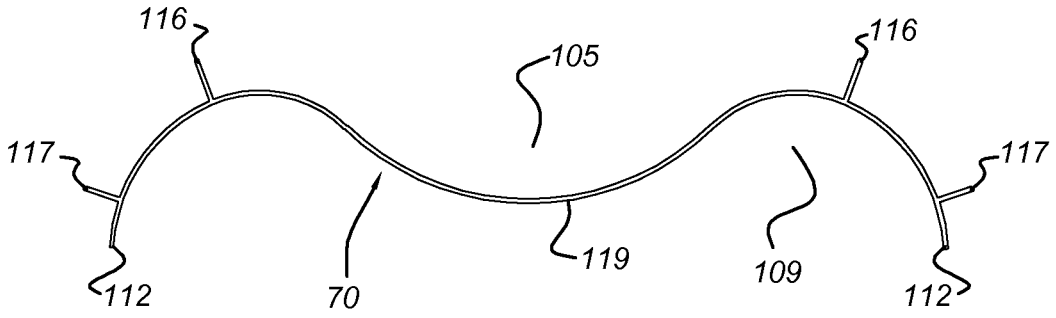
Figure 7:
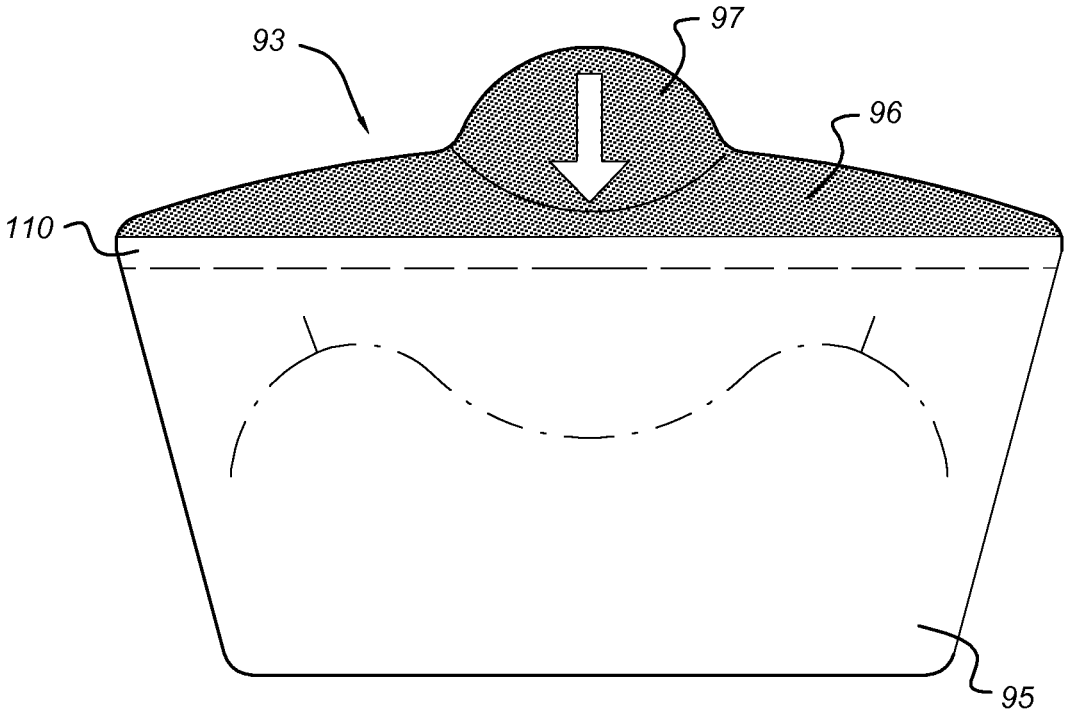

Other advantages, characteristics and details of the present invention are elucidated in the following description of some preferred embodiments with reference to the attached drawings, where:

FIG. 1 is an exploded side view of an embodiment of the packaging machine for packaging various products, including the film used for it FIG. 2 shows a front view of an embodiment of the packaging machine according to the invention, without the packaging film FIG. 3 shows a partially exploded detailed side view of the punching unit illustrated in FIGS. 1 and 2, especially the drive of its punch roll (magnetic roll) and backing roll FIGS. 4*a* and 4*b* show schematic side views of the punch roll and the backing roll in the initial position A before the punching operation, and in position B, immediately after the punching operation FIGS. 5*a*-5*d* show partially exploded top views of the steps performed by the user for opening a packaged product FIG. 6 shows a top view of a punch used for making an opening in the shrink film used for packaging the product FIG. 7 shows a schematic diagram of the shape of the label applied to a product illustrated in FIG. 4

Figure 8:
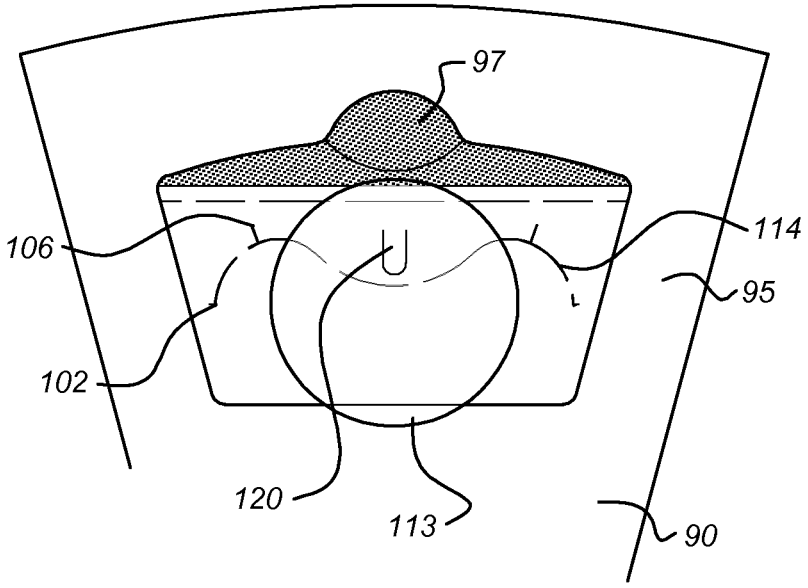

FIG. 8 shows a package in which a ventilation opening has been made in addition to the opening for opening the package, and FIGS. 9*a*-9*h* show schematically the details of some examples of suitable openings.

FIG. 1 shows a packaging machine for packaging a freely chosen product. In the example discussed here, the product is an irregularly shaped natural product, such as a piece of soft cheese. More especially, the product is shaped like a slice of pie that has to be packaged in a shrink film. The package should be such that it can be opened relatively easily and the user can remove the packaging from the product by hand without needing any tool.

The packaging machine 1 comprises: an unwinding unit 2 for feeding in a band of shrink film that is wound up on a roll; a cover-element-applying unit 3 (especially a labelling unit) that applies the cover elements (especially labels) to the shrink film; a punching unit 5 for making one or more openings in the shrink film; a feed conveyor 6 for feeding in the products (P) to he packaged; an inserting conveyor 7 (not shown) for placing the products (P) in the shrink film; and a flow-pack sealing unit 8 for sealing the package and then shrinking it over the product in question.

The unwinding unit 2 of the packaging machine 1 comprises a frame 10 that is set up on a base (o) and houses an unwinding roll 11. The unwinding roll 11 can be rotated on bearings in the frame 10. A length of shrink film 12 is wound up on the unwinding roll 11. This shrink film 12 generally has a thickness of 5-35 μm. If a different film is used, it should generally have a thickness of 5-150 μm and preferably 5-80 μm. A number of other rolls 14-21 are also mounted on the frame 10 to deliver the shrink film to the above-mentioned inserting conveyor 7. In the case illustrated here, these rolls 14-21 are not driven. The shrink film 12 is conveyed by the movement of the endless belt of the inserting conveyor 7. The latter pulls the band 13 of shrink film tightly off the unwinding roll 11 and conveys it first past the labelling unit 3 and then past the punching unit 5. The inserting conveyor is for example a conveyor belt, a series of articulated supports or containers such as trays, or a band of film in chain.

The labelling unit 3 is also mounted on the frame 10. The labelling unit 3 holds a number of labels that have been applied to a roll of supporting material 20. A dispensing device 18 can firmly stick these labels on one side of the band 13 of shrink film. The labelling unit 3 is coupled here to a central control unit 25 and it releases a label every time it receives a label-dispensing signal from this control unit 25.

The punching unit 5 is composed of a frame 30 in which a number of rolls are rotatably mounted. As FIGS. 2 and 3 show in more detail, the frame comprises two upright frame components 31, 32, between which are mounted a top roll 33 and a bottom roll 34. The bottom roll 34, which is called the backing roll 34 of the punch roll, has a cylindrical shape and is substantially hollow inside, in order to minimize its weight. The reason for this is that the backing roll 34 may have to react very quickly to variations in the feed velocity of the band 13 of shrink film, and it must therefore be able to perform great acceleration or deceleration. In an alternative embodiment, the backing roll 34 is substantially solid.

The backing roll 34 can be fitted with runners 35, 36 at its two opposite lateral ends. The runners 35, 36 lie close to the backing roll 34 and are made of a hard material, such as preferably a metal, as is also the backing roll itself. In some other embodiments, the backing roll is smooth and its separate bearing rings are omitted. The assembly formed by the backing roll and its runners is fitted with two shafts 37, 38, which are arranged in the upright parts 31, 32 of the frame 30 in such a way that they can rotate on their bearings 39, 40.

The backing roll 34 is driven by a servomotor 50 whose drive shaft 51 is coupled to the backing roll 34 by a transmission belt 52, such as for example a toothed belt. The servomotor 50 is regulated by a coding roll, comprising a tachometer and an encoder, shown in FIG. 1 as item 17. This coding roll determines the momentary speed of the band 13 of shrink film passing by it and transmits to the servomotor 50 a signal that represents this measured momentary speed, doing this either directly or via the above-mentioned control mechanism. In this way, the backing roll 34 can for example copy the variable speed of the band 13 of shrink film within a relatively narrow margin.

The top roll 33, situated on the top of the punching unit 5, which is also called a punch roll or magnetic cylinder 33, is designed to carry the punch, which is used to make an opening in the shrink film. The punch roll 33 comprises an elongated central part 42, which is rotatably mounted on the frame 30 with the aid of a bearing block 28. The elongated central part 42 has a roll 54 in the middle. This roll carries a punching tool that can make openings in the packaging material, as described later.

The central part 42 is coupled to two other runners 57, 58 through the bearings 43, 44, respectively. These runners are also made of a hard material. The runners 57, 58 run through the middle of the above-mentioned bearings 43, 44 against the bottom runners 35, 36 of the backing roll 34. They ensure that a constant (small) gap is kept between the outside wall of the backing roll 34 and the outside wall of the roll 54. To maintain this gap, two runners 29 are provided above the punch roll. The runners 29 are fixed in an adjusting bridge 45, the height of which can be adjusted upwards with the aid of two setting knobs 46, 46'. The running surfaces of the runners 29 can push the runners 57, 58 of the punch roll downward and so ensure that the punch roll keeps the right distance from the backing roll.

Roll 54 has a width $b_1$, shown in FIG. 2, which is smaller than the width $b_2$ of the backing roll 34 placed below it. Furthermore, roll 54 can be displaced sideways (in direction $R_1$ shown in FIG. 2) with the aid of a fixing aid 60, so that the tip of the punch can make an opening in the band 13 of shrink film in the required lateral position along the role section 42. The punch roll 33 is driven by another servomotor 62. This servomotor 62 has a driven shaft 63, which is coupled to the punch roll 33 by means of a drive belt 64 in order to drive it. The construction illustrated here makes it possible to rotate the punch roll 33 and the backing roll 34 independently of each other. Even when the backing roll is constantly rotating (though at different speeds, corresponding to the speed variations of the band 13 of shrink film), the punch roll 33 can be stationary, or it can rotate either faster or more slowly, while the punch 70, arranged on the circumference of the roll 54 shown in FIGS. 4*a* and 4*b*, can be placed in the right position at the right time with respect to the labels that have been stuck on the band 13 of shrink film.

The punch roll 33, or at least its roll 54, is fitted with a flexible metal plate 71 on its surface. This metal plate can be detachably fixed to the surface of the roll 54 of the punch roll 33 with the aid of some magnets, which are not shown. The plate 71 is fitted with at least one punch (a punching tool or a knife) 70, which can be for example a punch component in the form shown in FIG. 6. In the embodiment illustrated here, the punch 70 comprises an elongated and substantially wavy part 119, with a number of protuberances 116, 117 and ends 112. As described later in more detail, the punch 70 can make a corresponding opening in the shrink film. The protuberances 116, 117 mentioned above are used to form the corresponding tear-tabs 106, 107.

When the band 13 of shrink film that has been fed in has left the punching unit 5, it is led over a number of rolls 19-21 and past a number of photocells 75. The photocells 75 can detect the presence of a label on the moving band 13 of shrink film. The shrink film is then passed on to the inserting conveyor 7 mentioned before.

The inserting conveyor 7 has an endless conveyor belt 78, which can move on rolls, some of which are not shown here (thus, only the left-hand roll 79 is illustrated in FIG. 1). The band 13 of shrink film is placed on the endless conveyor belt 78, where it moves at the same speed towards the flow-pack sealing unit 8, mentioned above. As this can be a conventional flow-pack sealing unit, it is not shown in the figures. The function of the flow-pack sealing unit is to seal the film arranged over the product and then to pass the product with its sealed film into a shrink tunnel. The latter comprises an oven in which warm air is used to make the band 13 of shrink film shrink to such an extent that it tightly envelops the product.

Finally, the feed conveyor is of the conventional type and has an endless conveyor belt 80 that is moved on a number of rolls 81 and 82 and on which the products (P) are fed in for packaging singly or otherwise. FIG. 1 only shows a few products (P) in order to keep the drawing simple, but there can of course be a much greater number of them in practice.

During operation, the unwinding unit 2 feeds a band 13 of shrink film to the punch unit. The above-mentioned coding roll 17 (with a tachometer and an encoder) determines the speed of the band 13 of shrink film moving along it and sends an appropriate signal to the control unit 25 and/or to the servomotor 50 of the backing roll 34. The servomotor 50 now ensures that the backing roll 43 rotates at substantially the same speed. This means that the speed of the surface of the backing roll, which surface is in contact with the band 13 of shrink film, is substantially the same as the speed of the shrink film.

It is a feature of shrink film that it is very flexible, so it is not easy to ensure a constant speed for such a conveying mechanism. However, it is not necessary to ensure a constant speed of the band 13 of shrink film either in the construction illustrated here, because any variation in the speed of the band of film can be reproduced by the coding roll 17 (with its tachometer and encoder) and by the servomotor 50 of the backing roll.

The labelling unit receives a signal at a given moment to release a label. This signal comes from the control unit 25 and the roll 17, where there is also an encoder that measures the length in stages, the command being to release a cover element or label. The dispensing unit 18 then releases a label in the usual way and sticks it firmly on the side 22 of the band 13 of shrink film (see FIG. 1). This label is shown schematically as item 26 in FIG. 1. In the case of all the other labels 26, a control unit in the servomotor 50 calculates the cut-off length, that is, the required final length of the band of film needed for the product in question. As soon as this cut-off length is reached, the labelling unit 3 again receives a signal to release a label. The dispensing unit 18 then releases another label 26 and sticks it firmly on the band 13 of shrink film.

The cut-off length depends for example on the distance between the products that is needed for the satisfactory operation of the packaging machine. If the products are for example pieces of cheese that are approximately 170 mm long, and if the required distance between two successive products is for example 50 mm, then the required cut-off length should be set at 220 mm.

In some of the embodiments of the invention, the cut-off length is fixed according to for example the kinds, shapes, sizes and relative positions of the products P present on the feed conveyor 6. For this operation, a scanner 86 can be used for detecting at least one of the kinds, sizes and relative positions of the products P on the feed conveyor 6 and for sending the control unit 25 a detector signal that represents the results of the detection. The control unit 25 can then determine—according to the detector signal received from the scanner 86—how much packaging material has to be used for each product during the packaging operation. In some of the embodiments of the invention, the control unit 25 is used alternatively or additionally to determine—according to the detector signal received from the scanner 86—the required characteristics (especially the position, shape and/or dimensions) of the openings to be cut in the packaging material. In some of the embodiments of the invention, the control unit 25 is used alternatively or additionally to determine—according to the detector signal received from the scanner 86—the required position for placing the cover elements (labels) 26 on the packaging material. The control unit 25 can be coupled to at least one of the following: the cover-element applying unit (i.e. the labelling unit 3), the opening-making unit (i.e. the punching unit 5) and the packaging unit (i.e. the flow-pack sealing unit 8), so that these units can be set either individually or collectively to operate according to the detector signal coming from the scanner 86. In the example illustrated here, the scanner 86 is a CCD camera.

As soon as a label 26 is detected by the photocell 85 (or by another suitable sensor) positioned near the coding roll 17 (with its tachometer and encoder), a signal is sent to the control unit 25 and/or directly to the servomotor 62 of the punch roll 33. The punch roll 33, or at least the punch 70 on it, now stands in readiness in a predetermined initial position, for example in position A, shown in FIG. 4*a*. The servomotor 62 now rotates the punch 70 further on from its initial position (A) to a spot between the backing roll and the punch roll, also ensuring that this is done just at the moment when a label goes past the combination of backing roll and punch roll. Furthermore, the speed of rotation of the punch roll is regulated to match that of the backing roll and so that of the instantaneous displacement velocity of the film, this regulation being based on the signal that is emitted by the coding roll 17 and which is representative of the instantaneous speed of the packaging machine that has been determined.

For a number of reasons, the speed of displacement of the packaging material (film) generally varies in time. The speed of displacement at which the packaging material runs past the punching unit can vary, due to for example the film being stretched somewhere, and due to the fact that an advancing movement is produced when the film is treated in the packaging unit or on its conveyor, e.g. by the sealing bars of a flow-pack sealing machine. It is important that both rolls of the punching unit should copy this speed of displacement exactly.

Furthermore, the height h of the punch shown in FIG. 4*a* is chosen so that only the film 13 itself is punched through while the label is not, or substantially not punched through. In other words, an opening (a slit or a punched nick) is made in the film past the label without making a corresponding opening in the label itself. The punch roll turns on to position B, shown in FIG. 4*b*. The servomotor 62 then ensures that the punch roll rotates further at a high speed to its initial position A, shown in FIG. 4*a*. The speed of rotation is so high here that the punch 70 arrives again in its initial position A on time to perform the next punching operation. This process is then repeated every time the band 13 of shrink film is displaced over the predetermined cut-off length and a new label is placed again between the backing roll and the punch roll.

The band 13 of shrink film then continues on its way to the inserting conveyor 7. When the label 26 in question reaches the top photocells 75 with the film that has been punched through, these photocells generate a signal that makes the feed conveyor 6—either via the control unit 25 or otherwise—place a product (P) on the film that is being moved on to the inserting conveyor 7. This is done in such a way that there is a label 26 precisely under the product (P), with the film in between them, of course. The inserting conveyor is used here to create a gap between the products that is correct for the packaging machine (for example 50 mm). This gap can be different from the space between the products when they are still lying on the conveyor 80.

The inserting conveyor 7 then carries the product further towards the flow-pack sealing unit 8, where the film is closely sealed over the product, and the package is then passed into the shrink tunnel, where the film is tightly shrunk on the product. The flow-pack sealing unit is fitted for example with sensors that generate some detector signals, on the basis of which the sealing bars descend exactly between two products to form a tight seal over them. In the case of the above-mentioned pieces of cheese, the product is tightly sealed in along three sides. This ensures that a thickened film is created at the front, at the wide part, at the tip, and along the side of the product, because relatively large parts of the packaging material are shrunk on top of one another. These thickened film parts are often so tough that it is difficult or downright impossible to tear the packaging material open from them onward.

FIG. 5*a* shows an example of a product packed by the present method and/or by the packaging machine 1 described here. The product shown in FIG. 5*a* is a piece of soft cheese that has the conventional shape of a slice of pie. A shrink film 91 has been applied over this piece of soft cheese 90. It can also be seen here that the top of the film 91 has a punched opening 94 running transversely to the piece of soft cheese, and that a label 93 has been applied that lies on the film and covers up the punched opening 94. The shape of the label 93 is shown in FIG. 7 in more detail. The label has a main or body part 95, which is firmly stuck to the film with the aid of an adhesive, such as for example glue. The label 93 also has in its upper part an adhesive-free area or strip 96. The adhesive-free strip 96 (which also includes a strip with an adhesive that has been neutralized in the usual way) forms a projection or tab 97 that can be gripped by the user of the product.

FIG. 5*a* shows how the punched opening 94 extends under the label 93. The broken lines 100 and 101 show the parts, for example notional or real tear lines, where the user can tear into the film.

The user can tear into the film as follows. The small tab 97 is pulled downward. This tab can be easily grasped, because the glue-free strip 96 and the small tab 97 that form part of it do not have any glue on them. When the user pulls the opening piece downward (see step S1 in FIGS. 5*a* and 5*b*), the adhesive forces between the label and the shrink film ensure that the top parts 109 (see FIG. 6) of the shrink film just under the punched opening 94 also pull off with the label 93, so that they both come off the product at a given moment. When the user continues pulling and eventually pulls the film free to the very ends of the opening 94, further pulling on the film, approximately along the (notional) broken lines 100 that extend from the ends 102 of the opening 94, will cause the film to tear more widely open, right to the edge of the package (see opening step S1 in FIG. 5*b*). When the user then carries on pulling, the film is torn more open along the (notional) broken lines 100'. In this state, the package can sometimes be already easily removed from the product.

However, the problem remains that the top of the film, that is, the film at the widest side of the soft cheese 90, has not been removed yet. However, thanks to the special shape of the opening 94, part of the film (that is to say, the part 105 shown in FIG. 5*a*) can be used as a pull-tab. When the user then pulls this pull-tab 105, the film comes off. Partly due to the presence of the tear-tabs 106 extending upward, the shrink film is torn in the upward direction, approximately along the (notional) broken lines 101, which run from the corresponding tear-tabs 106, so that the upper part of the film can also be easily removed (this is opening step S2 in FIG. 5*c*). This situation is shown in FIG. 5*c*. In the embodiment illustrated here, the elongated opening 94 is provided with further tear-tabs or tear openings 108. These tear openings 107 enable the user to tear into the film obliquely sideways using the (notional) tear lines 108, which extend from the tear openings 107 (see FIG. 5*d*), in order to be able to partly tear off the remaining corner parts of the package (these are opening steps S3 and S4, shown in FIG. 5*d*).

In another embodiment, which is not shown here, there is—in addition to the glue-free strip 96 and the adhering part of the label—also a part of the label that is given a special layer of glue 110 (see FIG. 7), which makes it possible to close the package again, so a (partly) open package can be closed again for a time.

In another embodiment of the invention, the punch used is different from the one shown before as item 70. This alternative punch has two punching components. The first one has a first height and is used for making an opening only in the film, excluding the label, as described before. However, unlike in the case of the punch shown in FIG. 6, there are now only two protuberances instead of four, to form the tear-tabs 106, so the tear-tabs 107 are absent here. On the other hand, the second punching component has a greater height, so that its use produces both an opening 114 in the film 13, and an opening 120 in the label 93 (see FIG. 8). When a product is packed in a film that has an opening punched in and a label fitted to it in this way is passed into the flow-pack sealing unit 8, the product is tightly sealed in and then sent through the shrink tunnel, where air and gases can escape through the ventilation opening made in the label. This is an advantage in the flow-pack process, since the gases can escape through the ventilation opening 120 during the shrinking process. When the product has been sealed and shrink-packaged as described above, a second label 113 is stuck on the first one in such a way that the ventilation opening 114 in the package and in the first label 93 is sealed off, so that the product can be hermetically enclosed in the package and insulated from its surroundings.

The ventilation opening 120 preferably has a U-shape, but other shapes are of course also possible for it. Incidentally, the formation of a ventilation opening in a shrink film is well known in the prior art. However, the previous ventilation openings are often made in a different position, for example in a place opposite to where the label is located. According to the embodiment under discussion, on the other hand, the ventilation opening 120 can be formed on the same side of the product or even where the first label is located. When the ventilation opening is sealed off with a second label after the shrinking process, this second label can be stuck on the same side of the product or even over the first label.

FIGS. 9*a*-9*h* show some examples of embodiments of the opening 94 with a suitable shape for removing the packaging material from the product. The opening is always formed to enable the user to tear the package in a first direction and then in a different, second direction in order to remove the packaging material at least partly from the product. In some of the embodiments, the second direction is substantially opposite to the first one. In some alternative or further embodiments, the second direction is at an angle to the first one, being for example substantially normal to it. In the embodiments illustrated here, it is also possible, but perhaps not always necessary for removing the film from the product, to then remove the packaging material from the product in one or more other directions, for example sideways. The opening is therefore formed in the packaging signal for opening the packaging material in two, three or more directions.

Figure 9A:
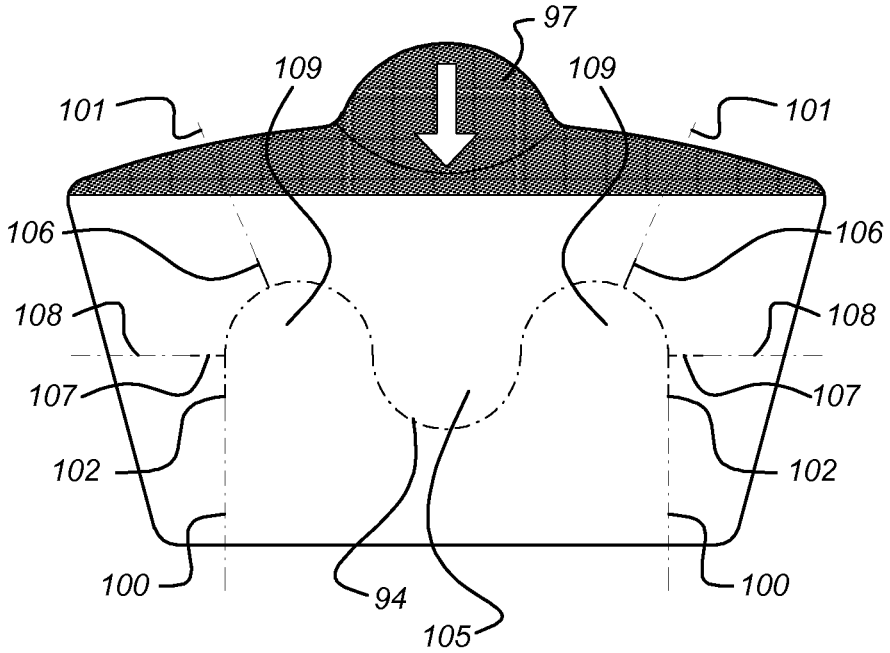

FIG. 9*a* again shows the opening 94 illustrated in FIGS. 5*a*-5*d*, with an elongated wavy part having two tear-tabs 106 extending upward, and two other tear-tabs 107 extending sideways at an angle. FIG. 9*a* also shows again the highest parts 109 of the film, which are directly under the punched opening 94. As described above, these parts 109 are pulled off with the label 93 and so they come off the product when the user pulls the tab 97 downward. FIG. 9*a* also shows the part 105 of the film that can be used as a pull-tab due to the special shape of the opening 94. As described above, the user can tear the film off the product in the upward direction, using part 105.

Figure 9B:
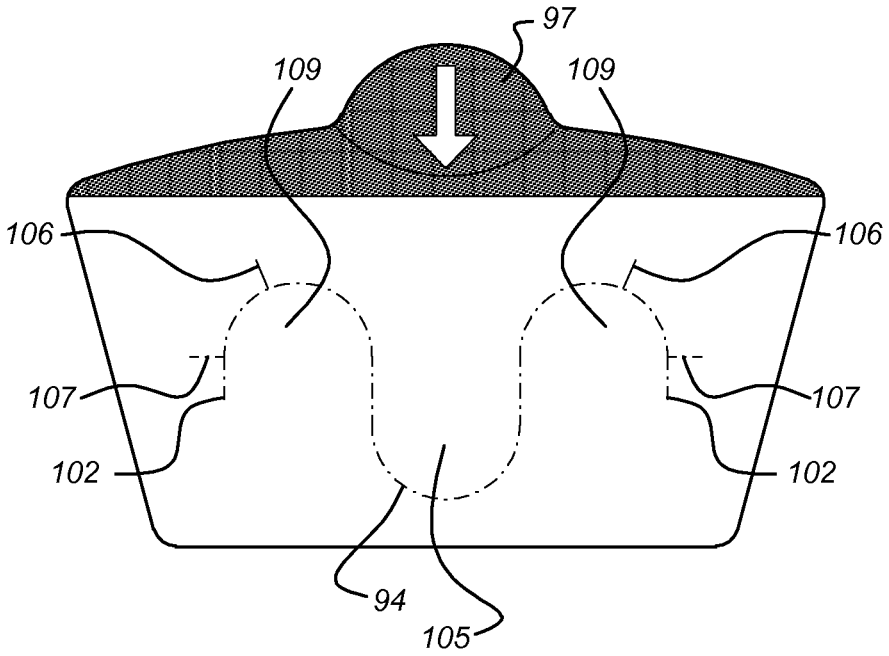

The alternative opening shown in FIG. 9*b* differs from that illustrated in FIG. 9*a* in that the part 105, which can be used as a pull-tab, now extends further from the crossways direction of the opening 94. This makes for a longer pull-tab, which is easier to grip by the user than the relatively short one formed by part 105 in FIG. 9*a*.

Figure 9C:
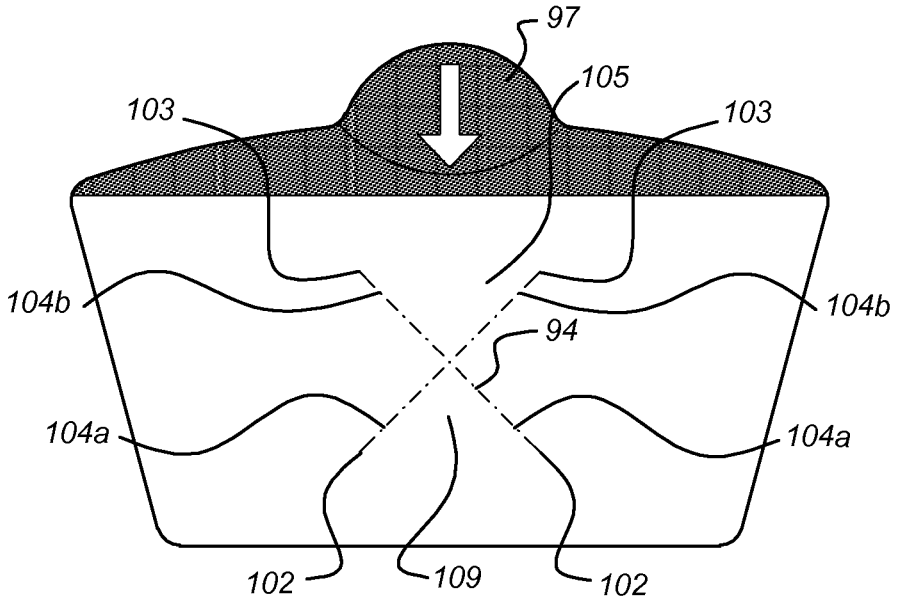

FIG. 9*c* shows a cross-shaped opening 94. This is substantially formed by two tear-tabs 104*a* that extend from the centre of the opening to the ends 102 obliquely downward, and by two tear-tabs 104*b* that extend from the centre of the opening to the ends 103 obliquely upward. A triangular part 109 is thus formed between the two tear-tabs 104*a*, which is pulled off as well when the user pulls the tab 97 downward, the situation being similar to what happens in the case of the parts 109 shown in FIG. 9*a*. The film is then torn open from the ends 102 of the tear-tabs 104*a* along the (notional) tear-lines, which extend obliquely downward from the ends. There is a triangular pull-tab 105, formed between the two tear-tabs 104*b*, with the aid of which pull-tab the user can then tear the film off the product in an (obliquely) upward direction, similarly to the case described above. The film then tears open from the ends 103 of the tear-tabs 104*b*, along the (notional) tear lines that extend from the ends 103 obliquely upward and which can therefore be removed from the product in that direction. Between the two tear-tabs 104*a* and 104*b*, there are two sideways-pointing triangular pull-tabs (not numbered), one on the left and one on the right, with the aid of which the user can then remove the film from the product laterally.

Figure 9D:
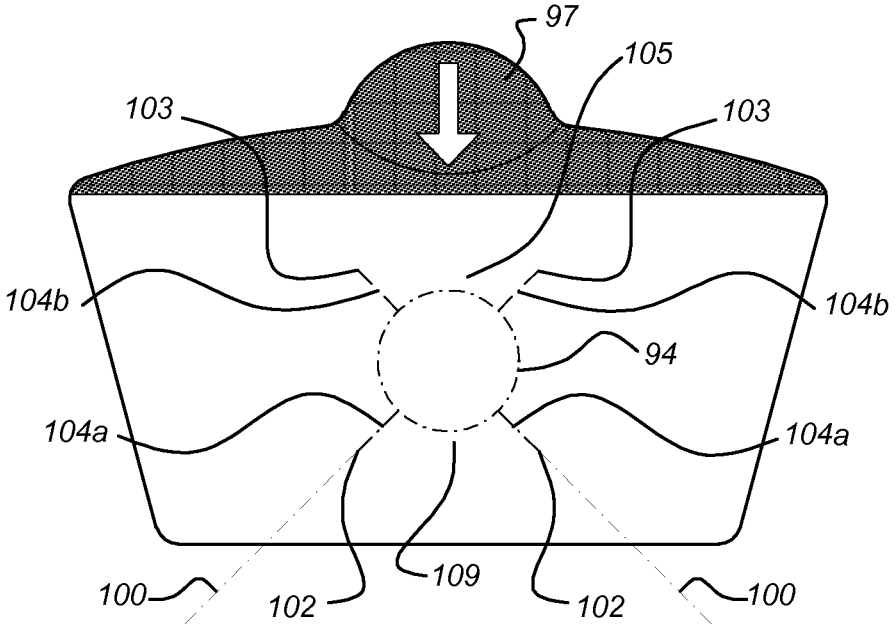

The alternative opening shown in FIG. 9*d* differs from the one shown in FIG. 9*c* in that the opening 94 now has a circular centre, from which the tear-tabs 104*a* and 104*b* extend crosswise, similarly to the case shown in FIG. 9*c*.

Figure 9E:
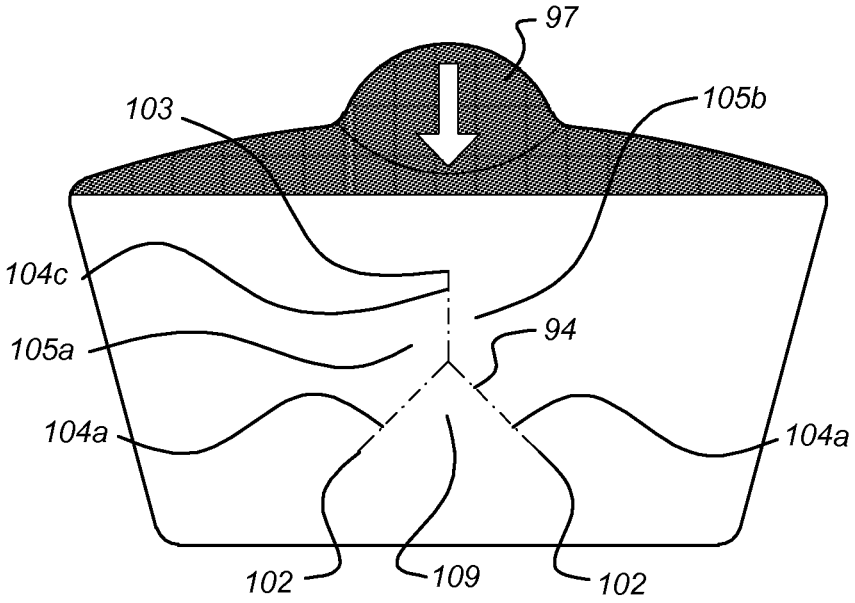

FIG. 9*e* shows a star-shaped opening 94, substantially formed by two tear-tabs 104*a*, which extend from the centre of the opening to the ends 102 running obliquely downward, and by a tear-tab 104*c*, which extends from the centre of the opening to the end 103 but runs in the upward direction. Between the two tear-tabs 104*a*, there is therefore a triangular part 109, which is also pulled off when the user pulls the tab 97 downward, similarly to the case of the triangular part 109 shown in FIG. 9*c*. The film will then tear open from the ends 102 of the tear-tabs 104*a*, along the (notional) tear lines that extend from these ends obliquely downward. Two substantially triangular pull-tabs 105*a* and 105*b* are formed between the tear-tabs 104*c* and the tear-tabs 104*a*. The user can then tear the film off the product with the aid of these triangular pull-tabs 105*a* and 105*b*. When the pull-tab 105*a* is pulled obliquely upward to the left, the film is torn further along a tear line that extends from the tear-tab 104*c*. The film then comes off the product and can be removed from it in the direction of the upper left corner. By pulling the pull-tab 105*b* obliquely upward to the right, the user can further pull the film off the product in the direction of the upper left corner of the product.

Figure 9F:
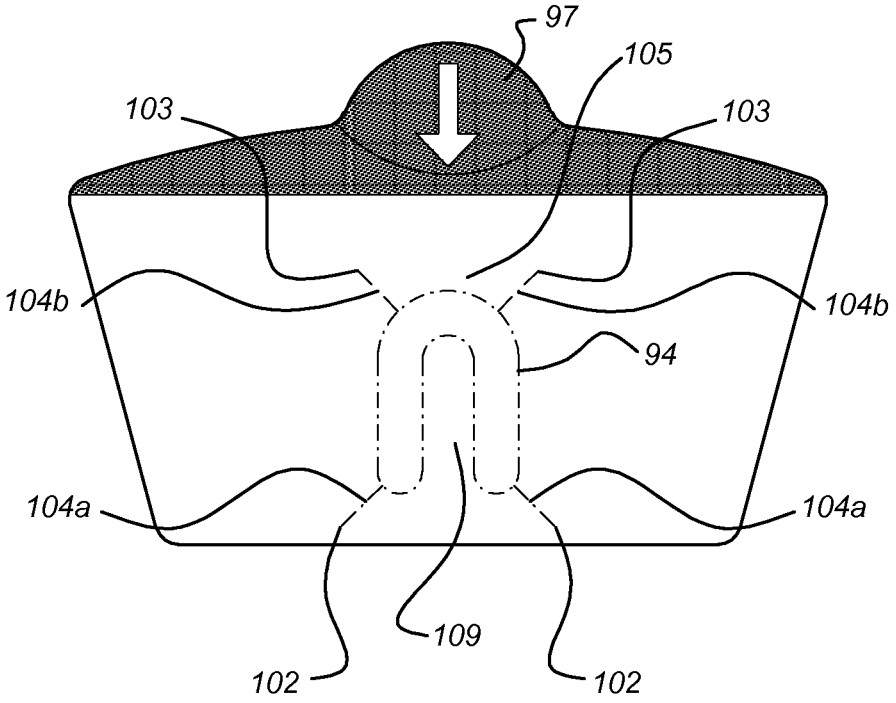
Figure 9G:
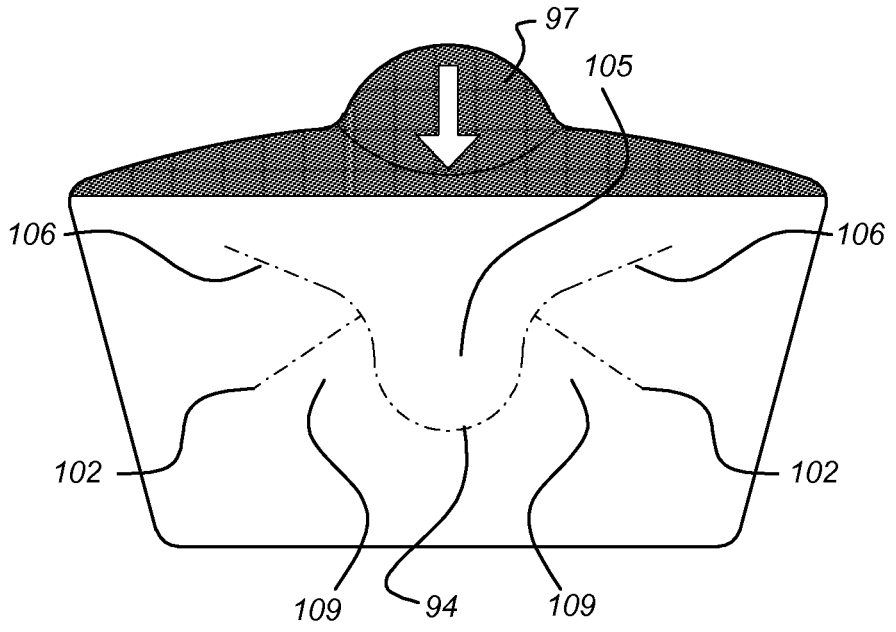

The opening shown in FIG. 9*f* differs from that illustrated in FIG. 9*d* in that the opening 94 now has a U-shaped part, from which the tear-tabs 104*a* and 104*b* extend similarly to the case shown in FIG. 9*d*. The base of the U-shaped opening points upward, so the part 109 is formed by the elongated inner part of the U. In an alternative embodiment not shown here, the base of the U-shaped part points downward, and the elongated inner part forms the pull-tab 105. FIG. 9*g* shows another alternative type of opening 94, with an elongated wavy part having two ends 102 and two tear-tabs 106, which extend upward. As in the case shown in FIG. 9*a*, the elongated part has two upper film sections 109, immediately below the punched opening 94. As described above, the sections 109 are pulled off with the label 93, so they come off the product, when the user pulls the tab 97 downward. Similarly to the case shown in FIG. 9*a*, the opening 94 can be used as a pull-tab, owing to its special shape, this pull-tab being shown here as item 105. When the user pulls the tab 97 downward, the film tears open from the ends 102 of the opening along the (notional) tear lines that extend obliquely downward from the ends 102. The user can then remove the film from the product in the upward direction with the aid of the pull-tab 105, similarly to the case shown in FIG. 9*a*. Between the obliquely upward pointing tear-tabs 106 and the obliquely downward pointing parts of the opening (which extend right to the ends 102), there are two sideways pointing triangular pull-tabs (not numbered), one on the left and one on the right, with the aid of which the user can then remove the film from the package in the upward direction.

Figure 9H:
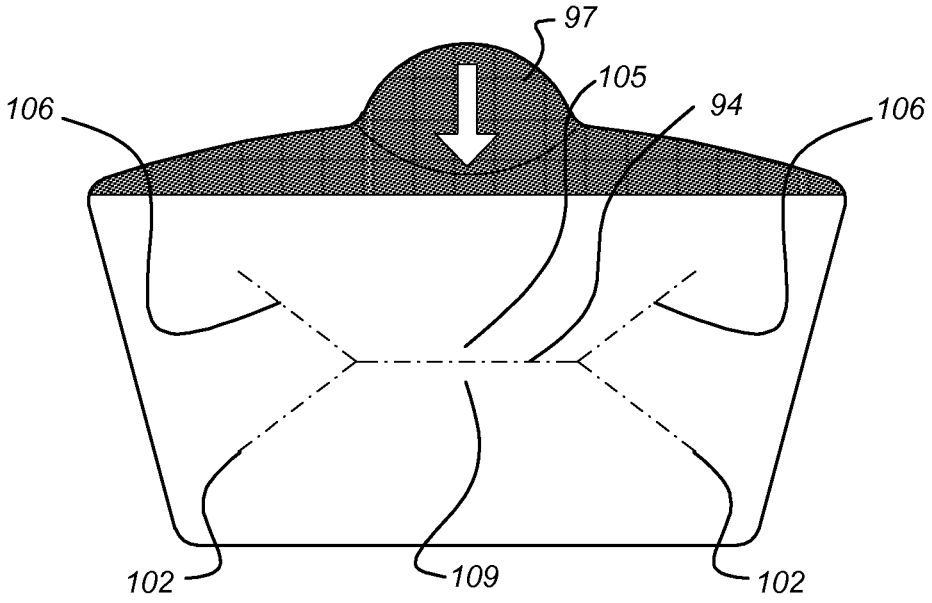

FIG. 9*h* shows another alternative type of opening 94, which has an elongated part, with a straight middle part, from which two sections extend obliquely downward, right to the two ends 102. These are also fitted with two tear-tabs 106, which extend in the upward direction. With the aid of the opening 94, the user can remove the film from the product in a way similar to that used in the case of the opening shown in FIG. 9*g*.

As an alternative to the mechanical punch described before, which can cut an opening in the film and/or in the label with the aid of a punch, a punching component 70 or a similar part, other means can also be used to make an opening. An example is a laser cutting unit, where a focussed laser beam is used for making an opening in the film and possibly also in the label. The advantage of such a laser system is that it is very accurate and works without making contact with the substrate, which reduces the wear and tear involved. The problem with such a laser solution is of course that it is generally more expensive.

In some other embodiments of the invention, the product is passed through the packaging machine for a first time in order to package it in a packaging material of a first kind, after which it is passed through the same packaging machine or through a different packaging machine a second time in order to package it in a packaging material of a second kind.

In the embodiments described above, the packaging device has an under-roll configuration (also called an under-feed configuration), but other configurations, such as an over-roll configuration (also called an over-feed configuration), are also known to the person skilled in the art. Other examples of configurations that lie within the scope of the present invention include those in which a packaging material with a cover element is used in a horizontal or vertical flow-pack machine, a top-seal machine, a deep-draw machine, a skin machine, a corner sealer or a similar sealing machine.

The device and method described here can be used to provide a product with a primary packaging, but they can also be used to provide a product or products with a secondary and/or tertiary packaging. The packaging material can be used for example to package a product or a set of products which has already been packed once or more than once.

Although packaging machines for packaging food products are often mentioned in the above embodiments, the invention is not limited to their use with food products. The method and device can in fact be also employed for example in numerous other fields outside the food sector, e.g. for packaging one or more electronic or optical data carriers (CDs and DVDs), for sealing carton boxes for the simple opening of these boxes (using the openings made in the package for the removal of the packaging material), and in the packaging of medicinal products. In this last case, the method according to the present invention can for example provide a way of sealing the packs with a secure closure.

Skin machines are currently available in different forms, ranging from traditional ones, which work off a roll, to more modern variants, such as those for example which work with pre-formed trays on top-sealers that are provided with a skin material, as well the modern deep-drawers, with a thermal after-treatment that makes it possible subsequently to shrink the film tightly over the product by the use of water or an immersion bath. All these skin machines lie within the scope of the present invention under the "skin machine" designation. The materials used for skinning here are called packaging materials used on skin machines, or simply skin films.

It has been mentioned above that shrink films are difficult to remove from the product without damaging the latter. This also applies to products packaged in a stretch film or a skin film. The present invention also helps to solve this problem and to simplify the opening of such packs. The use of the method and device according to the invention also reduces the risk of a leak from between the packaging material and its cover element. Thanks to the double opening direction, the products can be taken out of the package more easily. According to the invention, the user can freely choose between the spots for starting to open the package (at the label), and this characteristic can be used to optimize the system for each type of product during the packaging operation, thereby making the packs easier to open.

The present invention is not limited to the preferred embodiments described above as regards devices, methods, products and types of film. The rights sought here are instead defined in the following claims, and numerous variations and modifications are possible within their scope.

The invention claimed is:

1. A method for the in-line packaging of a product, comprising:

feeding in a packaging material, the packaging material being selected from a group of materials including at least a shrink film, a stretch film, a combined stretch-shrink film, and a packaging material used on a skin-packaging machine;

applying at least one cover element to the packaging material;

forming at least one first opening in the packaging material at the place of the cover element, substantially without forming a corresponding opening in the cover element that lies beyond it, which at least one first opening is arranged for opening the package by hand;

forming at least one second opening, at the place of the cover element, in the combination of the packaging material and the cover element that lies beyond it; and packaging at least one product in this packaging material, comprising placing at least one product on the packaging material and sealing the packaging material.

2. The method according to claim 1, further comprising:

feeding in the packaging material from a feed roll;

applying at least one cover element to the packaging material;

thereafter passing the packaging material to which the at least one cover element has been applied along a punching unit; and punching an opening in the packaging material at the place of the at least one cover element, which opening is arranged for opening the package by hand.

3. The method according to claim 2, wherein punching the opening in the packaging material comprises punching an opening in the packaging material right up to the cover element.

4. The method according to claim 1, further comprising:

feeding in the packaging material from a feed roll;

applying at least one cover element to the packaging material;

thereafter passing the packaging material to which the at least one cover element has been applied along a laser unit; and forming an opening by a laser beam in the packaging material at the place of the cover element, which opening is arranged for opening the package by hand.

5. The method according to claim 1, wherein sealing the package material includes using at least one of a sealing unit and a warming unit, in order to tightly enclose the product in the packaging material at least in part.

6. The method according to claim 5, further comprising passing the packaged product through a heat treatment unit, the heat treatment unit being selected from a group of heat treatment units including at least a shrinking unit, a shrink tunnel, and a water bath, in order to shrink the packaging material.

7. The method according to claim 1, wherein the cover element is selected from a group of cover elements including at least a label and a strip.

8. The method according to claim 1, wherein the packaging material has a thickness of between 5 and 150 μm.

9. The method according to claim 1, further comprising:

conveying a band of packaging material to a cover-element applying unit;

applying a series of cover elements to the band of packaging material using the cover-element applying unit;

passing the band of packaging material that has been fitted with cover elements along an opening-making unit; and forming an opening by means of the opening-making unit only in the packaging material every time a cover element passes, substantially without making a corresponding opening in the cover element that lies beyond it.

10. The method according to claim 9, wherein the opening-making unit is or comprises a punching unit, and the method comprises the following steps:

passing the band of packaging material that has been provided with cover elements along a punching unit; and punching an opening by means of the punching unit only in the packaging material every time a cover element passes, right up to the cover element.

11. The method according to claim 9, wherein the opening-making unit is or comprises a laser cutting unit, and the method comprises the following steps:

passing a band of packaging material that has been fitted with cover elements is passed along a laser cutting unit; and making an opening in the packaging material using the laser cutting unit each time a cover element passes the laser cutting unit, wherein the opening is formed only in the packaging material, substantially without making a corresponding opening in the cover element that lies beyond it.

12. The method according to claim 9, wherein the distance between successive cover elements is chosen at will, so that a desired cut-off length is ensured every time.

13. The method according to claim 12, wherein the cut-off length depends on at least one of a shape and size of the product to be packed or on a gap between products that is needed for correct operation of the packaging machine.

14. The method according to claim 1, further comprising passing the product through a sealing unit, the sealing unit being selected from a group of sealing units including at least a horizontal flow-pack machine, a vertical flow-pack machine, a stretch film machine, a skin film machine, a deep-draw machine, a corner sealing machine, a general sealing machine, and a top-seal machine.

15. The method according to claim 1, wherein a second cover element is applied over the second opening, after the packaging material has been shrunk over the product.

16. The method according to claim 1, wherein the at least one first opening made only in the packaging material is formed for tearing the packaging material in a first direction and then in a second direction, in order to remove the packaging material at least partly from the product, which second direction is selected from a group of directions including at least substantially opposite to and substantially normal to the first direction.

17. The method according to claim 16, wherein the at least one first opening has a special shape that makes it possible, after the packaging material has been torn in the first direction, to use part of the packaging material as a pull-tab in order to tear the packaging material in the second direction.

18. The method according to claim 16, comprising making an opening that has an elongated part and a number of tear-tabs, which are either substantially normal or oblique to the elongated part.

19. The method according to claim 1, wherein the at least one first opening in the packaging material is formed to open the packaging material in at least three directions.

20. The method according to claim 1, comprising:

carrying out the method steps to package the product in a first packaging material; and repeating the method steps to package the same product in a second packaging material.

21. The method according to claim 1, wherein the at least one first opening is made by forming a series of perforations, one after the other.

22. The method according to claim 1, wherein the product is selected from a group of foods including at least a piece of cheese and soft cheese.

23. The method according to claim 1, wherein the packaging material has a thickness of between 5 and 80 μm.

24. The method according to claim 1, wherein the packaging material has a thickness of between 5 and 35 μm.

25. The method according to claim 1, wherein the second opening is made as a ventilation opening.

26. A device for packaging a product, comprising:

a feed unit for feeding in a packaging material, the packaging material being selected from a group of materials including at least a shrink film, a stretch film, a combined stretch-shrink film, and a packaging material used on a skin machine;

a cover-element applying unit for placing at least one cover element on the packaging material;

a punching unit having a first punch component configured to cut a first opening in the packaging material right up to the cover element, substantially without making a corresponding opening in the cover element that lies beyond it, and having a second punch component configured to cut a second opening both in the packaging material and in the cover element that lies beyond it; and a packaging unit for packaging the product within the packaging material, comprising at least a sealing unit for sealing the product in the packaging material;

wherein the feed unit, the cover-element applying unit, the punching unit, and the packaging unit are integrated with one another to make it possible to use an in-line packaging process.

27. The device according to claim 26, wherein the first punch component is used to cut an opening in the packaging material right up to the cover element.

28. The device according to claim 26, wherein the punching unit comprises:

a rotatable backing roll, a rotatable punch roll, a first drive motor to drive the backing roll, a speed detector to determine a speed at which the packaging material is being fed in and to emit a velocity signal that represents feed velocity, and a control unit that is coupled to the first drive motor and to the speed detector, for regulating a speed of rotation of the backing roll in accordance with the velocity signal, wherein the control unit is used to emit a control signal that makes at least one of the speed and acceleration of the displacement of the backing roll substantially the same as the one of the packaging material that is being fed in.

29. The device according to claim 28, wherein the backing roll is at least partly hollow.

30. The device according to claim 28, wherein the punch roll can be rotated independently of the backing roll.

31. The device according to claim 28, comprising a second electrical drive motor for driving the punch roll, and a control unit that is coupled to this second drive motor and is used to regulate the latter.

32. The device according to claim 31, wherein both the control unit that is coupled to the second drive motor and the second drive motor itself are used to rotate the punch roll from a waiting position at the same speed as that of the backing roll, during the cutting of the openings, and to bring the punch roll to the next waiting position at a higher velocity, after it has made an opening.

33. The device according to claim 26, wherein the punching unit comprises:

a backing roll, a rotatable punch roll, where the punch roll and/or the backing roll are/is provided with two runners to make it possible to rotate the backing roll independently of the punch roll, and a frame, in which the backing roll and the punch roll are arranged to make it possible for the runners of the punch roll to rotate against the runners of the backing roll or against the backing roll itself, wherein the first and/or the second runners can rotate with respect to the backing roll and the punch roll, respectively.

34. The device according to claim 26, wherein the punching unit comprises:

a rotatable backing roll, and a punch roll that can be rotated substantially independently of the backing roll, wherein the punch roll has a central part and a punching part which is mounted such that it can be moved sideways with respect to the central part, wherein the punching part can be fixed in any lateral position with respect to the backing roll.

35. The device according to claim 26, wherein the punching unit comprises a laser cutting unit that is used to make at least one opening in the packaging material with the aid of a laser beam.

36. The device according to claim 26, wherein the packaging unit comprises a sealing unit, which sealing unit is selected from a group of sealing units including at least a horizontal flow-pack machine, a vertical flow-pack machine, a stretch film machine, a skin film machine, a deep-draw machine, a corner sealing machine, a general sealing machine and a top-seal machine.

37. The device according to claim 26, wherein the packaging material is at least one of a shrink film, a stretch film and a combined stretch-shrink film, and the packaging unit comprises one of a sealing unit to seal in the product, a sealing unit to seal the packaging material placed on the product, and a heating unit for shrinking the shrink film, the heating unit being selected from a group of heating units including a shrinking unit, a shrink tunnel, and a water bath.

38. The device according to claim 26, wherein the opening-cutting unit is used to make an opening that is suitable for tearing the packaging material in a first direction and then in a second direction, so as to remove the packaging material at least partly from the product which second direction is selected from a group of directions including at least substantially opposite to and substantially normal to the first direction.

39. The device according to claim 26, comprising a cover-element applying unit that is used, after making an opening in the cover element, to apply a second cover element to seal the said opening.

40. The device according to claim 26, wherein the distance between the successive cover elements can be adjusted to ensure a required cut-off length in each case.

41. The device according to claim 26, further comprising:

a feed conveyor for feeding in a series of products;

a scanner which is configured to detect at least one of relative positions, kinds and dimensions of the products on the feed conveyor, and for emitting a detector signal that is representative of the results of this detection; and control means that use the detector signal from the scanner to determine how much packaging material is needed for packaging each product.

42. The device according to claim 41, wherein the control units are used to determine a required cut-off length or lengths.

43. The device according to claim 26, further comprising:

a feed conveyor for feeding in a series of products;

a scanner which is configured to detect at least one of relative positions, kinds and dimensions of the products on the feed conveyor, and to emit a detector signal that represents the results of the detection; and control means that use the detector signal from the scanner to determine desired positions where the cover elements are to be applied to the packaging material.

44. The device according to claim 26, further comprising a feed conveyor for feeding in a series of products;

a scanner which is configured to detect at least one of relative positions, kinds and dimensions of the products on the feed conveyor, and to emit a detector signal that represents the results of the detection; and control means that use the detector signal from the scanner to determine desired properties, of openings to be made in the packaging material, which desired properties are selected from a group of properties including at least position, shape and dimensions.

45. The device according to claim 44, wherein the control means are coupled to at least one of: the cover-element applying unit, the punching unit and the packaging unit, in order to regulate them according to the detector signal.

* * * * *